US009865121B2

(12) United States Patent
Glenn, II et al.

(10) Patent No.: US 9,865,121 B2
(45) Date of Patent: Jan. 9, 2018

(54) MODULAR GAMING TERMINAL CONFIGURATIONS

(71) Applicant: Bally Gaming, Inc., Las Vegas, NV (US)

(72) Inventors: Robert J. Glenn, II, Elk Grove Village, IL (US); Christian L. Castro, Chicago, IL (US); Larry J. Pacey, Chicago, IL (US); Paul M. Lesley, Blue Island, IL (US); Walter E. Smolucha, Melrose Park, IL (US); Christopher W. Chudek, Evanston, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 700 days.

(21) Appl. No.: 14/341,404

(22) Filed: Jul. 25, 2014

(65) Prior Publication Data

US 2015/0087401 A1 Mar. 26, 2015

Related U.S. Application Data

(60) Provisional application No. 61/880,298, filed on Sep. 20, 2013, provisional application No. 61/880,313, (Continued)

(51) Int. Cl.
*G07F 17/32* (2006.01)

(52) U.S. Cl.
CPC ..... *G07F 17/3211* (2013.01); *G07F 17/3216* (2013.01); *G07F 17/3246* (2013.01)

(58) Field of Classification Search
CPC ..... G07F 17/3211; G07F 17/3216; G07F 17/3246; H01R 13/00; H01R 11/00; H01R 13/052; H01R 13/111
See application file for complete search history.

(56) References Cited

U.S. PATENT DOCUMENTS 4,440,457 A * 4/1984 Fogelman ..... A63F 13/08 312/223.3
5,323,475 A * 6/1994 Marsden ..... G02B 6/245 385/77

(Continued)

*Primary Examiner* — David L Lewis
*Assistant Examiner* — Matthew D. Hoel
(74) *Attorney, Agent, or Firm* — David J. Bremer

(57) ABSTRACT

Gaming machines, gaming systems, modular gaming terminals, and methods for assembling modular gaming machines are disclosed. A gaming machine is presented which includes an input device for receiving wagers to play a wagering game, and a display module with a display device for displaying outcomes of the wagering game. The display device is coupled to a display module housing, which includes a male or a female mounting interface. The gaming machine also includes a core module with an electrical bus that electrically connects to the display device. A core housing, which stows the electrical bus and supports the display module, includes the other one of the male and female mounting interfaces. The female mounting interface receives the male mounting interface such that moving the male interface into the female interface automatically aligns the display module with the core module and removably attaches the core housing to the display housing.

16 Claims, 14 Drawing Sheets

Related U.S. Application Data filed on Sep. 20, 2013, provisional application No. 61/969,324, filed on Mar. 24, 2014.

(56) References Cited

U.S. PATENT DOCUMENTS 5,681,220 A 10/1997 Bertram
5,813,914 A 9/1998 McKay et al.
D403,363 S 12/1998 McGahn et al.
D404,436 S 1/1999 McGahn et al.
D416,054 S 11/1999 McGahn et al.
5,980,072 A * 11/1999 Zirkle ..... B63B 45/06 362/363
6,135,884 A 10/2000 Hedrick et al.
6,261,282 B1 * 7/2001 Jepson ..... A61M 39/045 128/912
D451,150 S 11/2001 Hedrick et al.
D451,151 S 11/2001 Hedrick et al.
D451,152 S 11/2001 Hedrick et al.
6,368,216 B1 4/2002 Hedrick et al.
6,575,541 B1 6/2003 Hedrick et al.
6,669,681 B2 * 12/2003 Jepson ..... A61M 39/045 128/912
6,820,875 B1 * 11/2004 Hedrick ..... A63F 13/08 273/138.1
7,226,215 B2 * 6/2007 Bareel ..... G02B 6/3821 385/60
7,452,280 B2 11/2008 Kopera et al.
7,905,783 B2 3/2011 Cole
7,977,857 B2 * 7/2011 Below ..... H01T 13/32 313/141
8,012,026 B2 * 9/2011 Dreyer ..... G07F 17/32 463/1
8,016,683 B2 9/2011 Cole
8,029,369 B2 * 10/2011 Hahn ..... A47C 9/022 297/172
8,172,688 B2 5/2012 Cole
8,303,420 B2 11/2012 Chudek et al.
8,312,788 B2 * 11/2012 Kwon ..... F16C 1/105 74/502.4
9,406,604 B2 * 8/2016 Cho ..... H01L 23/5223
2001/0048587 A1 12/2001 Yim
2004/0018870 A1 1/2004 Cole
2004/0048672 A1 * 3/2004 Hussaini ..... A63F 13/02 463/46
2004/0048674 A1 * 3/2004 Hussaini ..... A63F 13/02 463/46
2004/0121645 A1 6/2004 Postrel
2005/0064941 A1 * 3/2005 Hedrick ..... A63F 13/08 463/46
2005/0064942 A1 * 3/2005 Hedrick ..... A63F 13/08 463/46
2005/0079904 A1 * 4/2005 Hussaini ..... G11B 33/10 463/1
2005/0202879 A1 * 9/2005 Hussaini ..... G06F 1/1605 463/47
2005/0207100 A1 9/2005 Heckerman
2005/0215325 A1 9/2005 Nguyen et al.
2006/0073900 A1 4/2006 Cole
2006/0128475 A1 * 6/2006 Vitito ..... B60K 35/00 463/46
2006/0154732 A1 7/2006 Tastad
2006/0183544 A1 8/2006 Okada
2007/0099698 A1 5/2007 Cole
2007/0275783 A1 * 11/2007 Hussaini ..... A63F 13/25 463/47
2008/0113821 A1 * 5/2008 Beadell ..... G07F 17/3216 463/46
2008/0182642 A1 7/2008 Cole
2008/0254880 A1 * 10/2008 Dreyer ..... G07F 17/32 463/31
2008/0268950 A1 * 10/2008 Hussaini ..... A63F 13/02 463/31
2009/0209324 A1 8/2009 Graf
2010/0087259 A1 4/2010 Johnson et al.
2011/0077070 A1 * 3/2011 Jadeja ..... G07F 17/3211 463/25
2011/0092283 A1 * 4/2011 Levitan ..... A63F 13/08 463/31
2011/0314654 A1 12/2011 Cole
2012/0028708 A1 * 2/2012 Dreyer ..... G07F 17/32 463/31

* cited by examiner

MODULAR GAMING TERMINAL CONFIGURATIONS

CLAIM OF PRIORITY AND CROSS-REFERENCE TO RELATED APPLICATIONS

This application claims the benefit of priority to U.S. Provisional Patent Application No. 61/880,298, which was filed on Sep. 20, 2013, U.S. Provisional Patent Application No. 61/880,313, which was filed on Sep. 20, 2013, and U.S. Provisional Patent Application No. 61/969,324, which was filed on Mar. 24, 2014, each of which is incorporated herein by reference in its respective entirety.

COPYRIGHT

A portion of the disclosure of this patent document contains materials which are subject to copyright protection. The copyright owner has no objection to the facsimile reproduction by anyone of the patent disclosure as it appears in the U.S. Patent and Trademark Office patent files or records, but otherwise reserves all copyright rights whatsoever.

TECHNICAL FIELD

The present disclosure relates generally to wagering games, as well as gaming devices, gaming systems, and methods for playing wagering games. More particularly, aspects of the present disclosure relate to modular wagering game terminals.

BACKGROUND

Gaming terminals, such as slot machines, video poker machines and the like, have become a cornerstone of the gaming industry. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Thus, gaming manufacturers continuously endeavor to develop new games and improved gaming features and enhancements that will attract frequent play and player loyalty through enhanced entertainment value to the player.

Heretofore, gaming machine design and innovation has focused primarily on displays, lighting, and other attraction devices, system networking and configuration, payout mechanisms, and most predominantly on game play, such as base game features and enhancements, bonus rounds, and progressive-type game play. Gaming terminal cabinets have received less attention, with such attention being generally limited to enhancing cabinet ergonomics and improving player convenience. Relatively little research and development has been dedicated to optimizing cabinet flexibility and scalability for cross-platform integration.

For existing gaming terminals, the construction, footprint and appearance of the cabinet are usually fixed once the gaming terminal is released from the manufacturer and placed on the casino floor. One reason for this lack of flexibility is the difficulty involved in altering the construction and appearance of an already assembled gaming terminal. For example, gaming machines have historically been limited to a fixed cabinet configuration with a dedicated primary display, top box and top-box mounted marquee or light, and rigidly mounted artwork panels and other signage. In addition, the electrical hardware, circuitry, and peripheral devices for each gaming terminal are normally fixed for a particular type of terminal configuration. To alter game offerings, casino operators or contracted technicians are therefore required to either replace the entire gaming machine or to replace many of the machine's components, such as the artwork, top box and marquee. For instances where the operator wishes to change the footprint or overall appearance of a gaming machine, or desires to modify the cabinet's hardware, the entire terminal must typically be replaced. The replacement process is costly, time consuming, and counter-productive to maintaining pace with the continuously changing gambling industry. There is therefore a need for a modular gaming machine configuration which offers greater flexibility for quickly and easily changing the construction and appearance of the terminal.

SUMMARY

Disclosed herein are wagering game systems and machines with various modular gaming terminal features and configurations (any recitation herein of "terminal" or "machine" or "device" can be used interchangeably unless explicitly disclaimed). Many of the concepts described herein represent means for delivering flexible and changeable cabinet configurations to the market that take advantage of simple yet standardized interfaces. Segmenting the gaming cabinet into functional sections, and partitioning those sections into connectable units, for example, enables configuration changes that can present dramatically different product propositions and, thus, optimize cabinet flexibility for cross-platform integration. Some of the disclosed features help to minimize research and development efforts and thereby enable an accelerated product release cadence without the level of development investment that would otherwise be required. Additionally, decoupling functional elements and segmenting those elements appropriately helps to enable far ranging options of distinctive styling approaches.

Some of the disclosed concepts are directed to a mechanical mounting interface for modular multi-display gaming machine configurations. The mechanical mounting interface enables coupling of different display modules (e.g., HiDef flat-screen primary and secondary video displays) and/or accessory modules (e.g., top boxes, lighting arrangements and/or marquees) to a universal base (also referred to herein as "core module"). Some embodiments utilize self-locating guide pins that are received in complementary frustaconical guide slots to properly align and connect each display/accessory module for attachment to the core module, either directly or via an intermediate display/accessory module. Standard mechanical fasteners, such as threaded bolts or screws, can be utilized as secondary attachment means to complete the mechanical attachment. This concept can be extended to other cabinet elements, such as button panels and internal core features.

Other disclosed features are directed to modular gaming machine configurations with a flexible platform footprint. Modular gaming machine designs with segmented functional modules of differing configurations couple to a universal mounting base (or "core module") to enable numerous gaming machine configurations each with a distinct footprint. These segmented modules allow for the coupling of different displays and accessories to a core module to modify the gaming machine's width and/or height. The core module provides structural and functional support for any of an array of display and accessory modules each having separate module characteristics and dimensions. The core module helps to ensure compliance with customer indexing restrictions without foregoing the option for higher/lower/wider/thinner machine configurations.

Additional concepts are directed to modular gaming machine configurations with modular trim structures for creating a unified terminal appearance. Modular gaming machine configurations with segmented functional modules each having a corresponding aesthetic module with a distinct design to enable varying gaming machine configurations each with a different aesthetic appearance. For some implementations, coupling of a distinct skin or trim structure to a core module and distinct skins/trim structures to the display modules allow for simplified modification of the gaming machine's appearance by decoupling function and separating the aesthetic skin from the underlying support structure. The aesthetic modules of the various functional modules cooperate and interconnect, overlap or otherwise fit together to maintain a seamless appearance.

One or more of the foregoing concepts, utilized singly or in conjunction with other disclosed features, deliver a wide range of product permutations to address equally wide ranges of market and customer driven needs. Beneficial aspects of this approach relative to product positioning touch on: cost scalability; distinctive feature flexibility; component integration flexibility; configuration optioning; multiple and distinctive brand languages; sizing and configuration format flexibility; and, overall game-changing form factor enablement. Some of the other benefits attendant to one or more of the disclosed concepts include: a modular gaming terminal configuration that can be easily and rapidly modified to meet continually changing operator demands; a modular gaming terminal configuration that satisfies venue operator restrictions while still maintaining the desired functionality and appearance of the gaming terminal; and, a flexible modular gaming terminal architecture that simplifies and reduces design and manufacturing time and costs.

According to one aspect of the present disclosure, a gaming machine for conducting a wagering game is disclosed. The gaming machine includes an input device that is configured to receive a wager to play the wagering game, and a display module with a display device that is operable to display a randomly selected outcome of the wagering game. A display module housing, to which is coupled the display device, includes one of a male and a female mounting interface. The gaming machine also includes a core module with an electrical bus that is configured to electrically connect to the display device. A core housing of the core module, which stows therein the electrical bus and provides structural support for the display module, includes the other one of the male and the female mounting interface. The female mounting interface is configured to receive the male mounting interface such that moving the male mounting interface into the female mounting interface automatically aligns the display module with the core module and removably attaches the core housing to the display housing. For some optional configurations, the display module housing and core housing each includes both a male and a female mounting interface that cooperate with their corresponding counterparts on the adjacent housing.

According to another aspect of the present disclosure, a modular gaming terminal for conducting a wagering game is presented. The modular gaming terminal includes an input device for receiving a wager to play the wagering game, and a display module with a video display device mounted to and supported by a display module housing. The video display device is operable to display a randomly selected outcome of the wagering game. The display housing includes a display housing frame with a sidewall and a base plate defining therethrough a guide slot. The modular gaming terminal also includes a core module with a central processing unit (CPU) and an electrical bus mounted inside the core module's housing. The electrical bus electrically connects the video display device of the display module to the CPU of the core module. The core housing includes a core housing frame with a sidewall and a top plate for supporting thereon the display module. Projecting upwardly from the top plate is a self-locating guide pin. The guide slot is configured to receive the self-locating guide pin such that moving the guide pin into the guide slot automatically positions the display housing sidewall adjacent the core housing sidewall and positions the base plate of the display housing against the top plate of the core housing.

Other aspects of the present disclosure are directed to a method for assembling a gaming machine operable to conduct a wagering game. The method includes: providing a display module with a display device for displaying a randomly selected outcome of the wagering game, the display module including a display housing to which is coupled the display device, the display housing including one of a male mounting interface or a female mounting interface; providing a core module with an electrical bus that is configured to electrically connect to the display device, the core module including a core housing stowing therein the electrical bus and configured to support the display module, the core housing including the other one of the male mounting interface or the female mounting interface; and, moving the male mounting interface into the female mounting interface whereby the display module automatically aligns with the core module and the core housing removably attaches to the display housing.

Additional aspects of this disclosure are directed to a method for assembling a modular gaming terminal that is operable to conduct a wagering game. The method includes: providing a primary display module with a primary video display device that is mounted to and supported by a primary display housing, the primary video display device being operable to display a randomly selected outcome of the wagering game, the primary display housing including a primary display housing frame with a sidewall, a top wall including a first guide pin, and a base plate defining therethrough a first guide slot; providing a secondary display module with a secondary video display device or a secondary game-related accessory, or both, mounted to and supported by a secondary display housing, the secondary display housing including a secondary display housing frame with a sidewall and a base plate defining therethrough a second guide slot; providing a core module with a processing unit and an electrical bus mounted inside a core housing, the electrical bus being configured to electrically connect the primary video display device to the processing unit, the core housing including a core housing frame for supporting thereon the primary and secondary display modules, the core housing frame including a sidewall and a top plate top plate with a second guide pin; moving the second guide pin into the first guide slot whereby the primary display module automatically aligns with the core module and the core housing removably attaches to the primary display housing; and, moving the first guide pin into the second guide slot whereby the secondary display module automatically aligns with the primary display module and the primary display housing removably attaches to the secondary display housing.

Aspects of the present disclosure are directed to a module system for providing gaming machines for conducting wagering games. The module system includes first and second display modules, first and second sets of outer fascia elements (e.g., outer fascia panels and aesthetic trim structure), and a core module. The first display module has a first set of dimensions and includes a first display device that is operable to display a randomly selected outcome of a first wagering game. The second display module, by comparison, has a second set of dimensions, which is different from the first set of dimensions of the first display module, and includes a second display device that is operable to display a randomly selected outcome of a second wagering game. The first set of outer fascia (also spelled "facia") elements is configured to attach to the first display module, whereas the second set of outer fascia elements is configured to attach to the second display module. The core module includes a core housing with an electrical bus that is stowed inside the core housing. The core housing is configured to attach to and provide subjacent support for both the first and second display modules, but only one display module at any given time. Likewise, the electrical bus is configured to electrically connect to both the first and second display devices, but only one at any given time. Mounting the first display module and the first set of outer fascia elements onto the core housing provides a first distinct gaming machine configuration with a first distinct footprint, whereas mounting the second display module and the second set of outer fascia elements onto the core housing provides a second distinct gaming machine configuration with a second distinct footprint. For some embodiments, the first and second sets of outer fascia elements are structurally distinct from one another such that mounting the first display module and first set of fascia elements onto the core housing provides the first distinct gaming machine configuration with a first distinct outer appearance, whereas mounting the second display module and second set of fascia elements onto the core housing provides the second distinct gaming machine configuration with a second distinct outer appearance.

According to another aspect of the present disclosure, a modular gaming terminal for conducting a wagering game is presented. The modular gaming terminal includes one of a first display module or a second display module. The first display module has a first set of dimensions and includes a first display device for displaying randomly selected outcomes of a first wagering game. Contrastingly, the second display module has a second set of dimensions that is different from the first set of dimensions of the first display module, and includes a second display device for displaying randomly selected outcomes of a second wagering game that is distinct from the first wagering game. The modular gaming terminal also includes one of a first set of outer fascia elements that is configured to attach to the first display module, or a second set of outer fascia elements that is configured to attach to the second display module. The second set of fascia elements is at least partially structurally distinct from the first set of fascia elements. The modular gaming terminal further includes a core module with an electrical bus and an electrical power regulation unit stowed inside a core housing. The core housing is configured to attach to and provide subjacent support for the selected one of the display modules, while the electrical bus and the electrical power regulation unit are configured to electrically connect to the selected one of the display modules. Mounting the first display module and the first set of outer fascia elements onto the core housing provides a first distinct gaming machine configuration with a first distinct outer appearance, whereas mounting the second display module and the second set of outer fascia elements onto the core housing provides a second distinct gaming machine configuration with a second distinct outer appearance.

Other aspects of the present disclosure are directed to a method for assembling modular gaming machines operable to conduct wagering games. The method includes: providing a first display module which includes a first display device that is operable to display a randomly selected outcome of a first wagering game, the first display module having a first set of dimension; providing a second display module that includes a second display device that is operable to display a randomly selected outcome of a second wagering game, the second display module having a second set of dimensions that is different from the first set of dimensions of the first display module; providing a first set of outer fascia elements that is configured to attach to the first display module; providing a second set of outer fascia elements that is configured to attach to the second display module; providing a core module including a core housing with an electrical bus stowed inside the core housing, the core housing being configured to attach to and provide subjacent support for both display modules, but only one at a given time, and the electrical bus being configured to electrically connect to both display devices, but only one at a given time; and, mounting either: (a) the first display module and the first set of outer fascia elements onto the core housing to thereby provide a first distinct gaming machine configuration with a first distinct footprint, or (b) the second display module and the second set of outer fascia elements onto the core housing to thereby provide a second distinct gaming machine configuration with a second distinct footprint.

In accordance with additional aspects of this disclosure, a method is disclosed for assembling a modular gaming terminal operable to conduct a wagering game. This method includes: providing a core module including a core housing with an electrical bus and an electrical power regulation unit stowed inside the core housing; mounting on top of the core module one of:

(A) a first display module that includes a first display device that is operable to display randomly selected outcomes of a first wagering game, the first display module having a first set of dimensions; or (B) a second display module that includes a second display device that is operable to display randomly selected outcomes of a second wagering game that is distinct from the first wagering game, the second display module having a second set of dimensions that is different from the first set of dimensions of the first display module;

mounting to the core module one of:

(A) a first set of outer fascia elements if the first display module is mounted onto the core housing to thereby provide a first distinct gaming machine configuration with a first distinct outer appearance; or (B) a second set of outer fascia elements if the second display module is mounted onto the core housing to thereby provide a second distinct gaming machine configuration with a second distinct outer appearance; and, electrically connecting, via one or more electrical connectors, the respective display device of the mounted one of the display modules to the electrical power regulation unit and the electrical bus of the core module.

The above summary is not intended to represent each embodiment or every aspect of the present disclosure. Rather, this summary merely provides an exemplification of some of the novel features presented herein. The above features and advantages, and other features and advantages of the present invention, will be readily apparent from the following detailed description of exemplary embodiments and modes for carrying out the present invention when taken in connection with the accompanying drawings and the appended claims.

Figure 1:
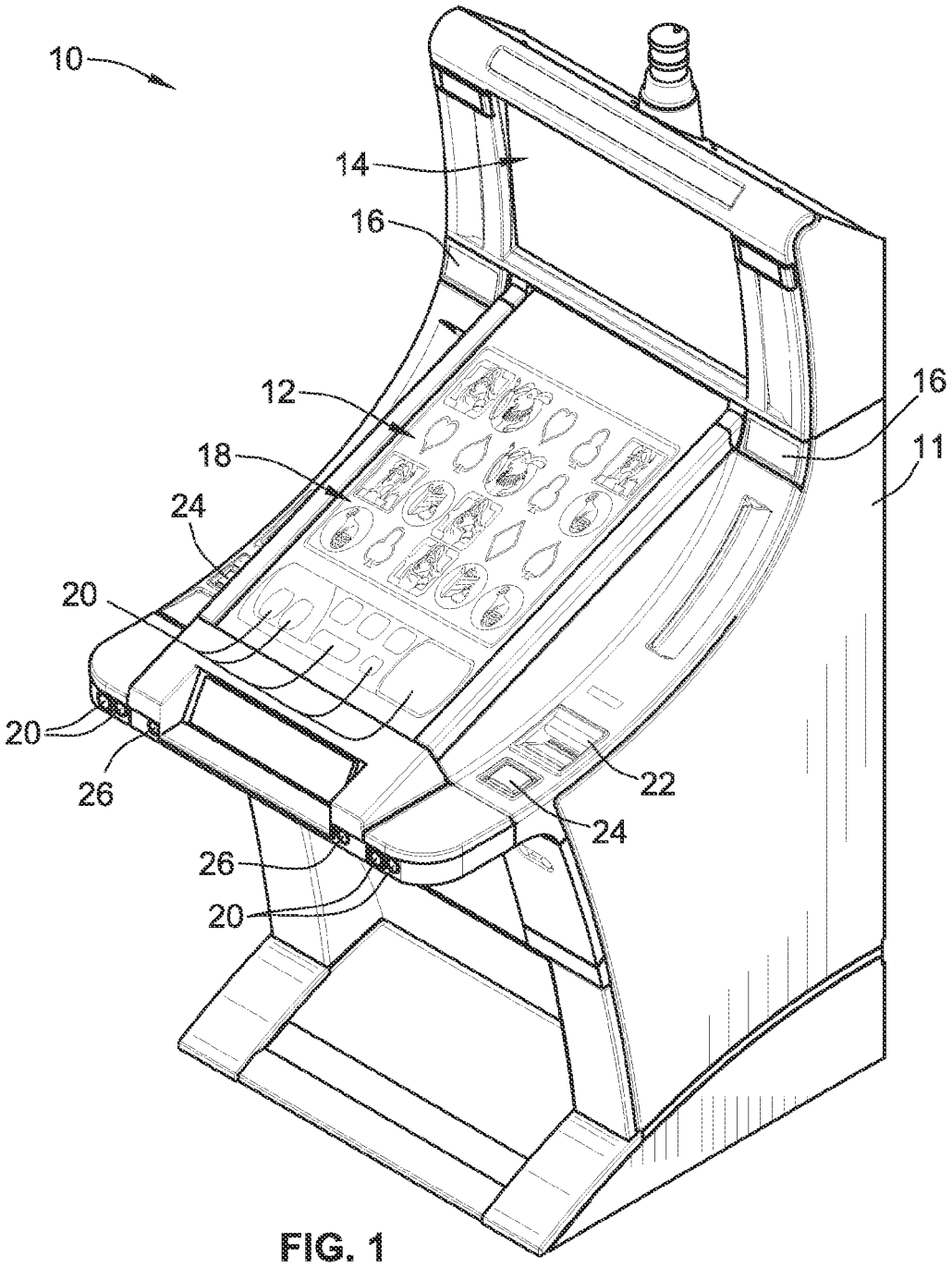
FIG. 1 is a perspective-view illustration of an example of a free-standing gaming terminal according to aspects of the present disclosure.

While aspects of this disclosure are susceptible to various modifications and alternative forms, specific embodiments are shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

This invention is susceptible of embodiment in many different forms. There are shown in the drawings and will herein be described in detail representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" mean "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games. It should also be noted that the recitation of a gaming terminal, machine, device or system can be used interchangeably in the specification and claims, unless explicitly delimited.

Referring to the drawings, wherein like reference numerals refer to like features throughout the several views, there is shown in FIG. 1 a representative gaming terminal 10 similar to those used in conventional gaming establishments, such as casinos, hotels and cruise ships, and non-conventional gaming establishments, such as airports and restaurants. With regard to the present disclosure, the gaming terminal 10 may be any type of gaming terminal and may have varying structures and methods of operation. For example, in some aspects, the gaming terminal 10 is an electromechanical gaming terminal configured to play slots with mechanical reels, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models (as shown), handheld mobile devices, bartop models, workstation-type console models, etc. Further, the gaming terminal 10 may be primarily dedicated for use in conducting wagering games, or may include non-dedicated devices, such as mobile smartphones, personal digital assistants, personal computers, etc. Exemplary types of gaming terminals are disclosed in U.S. Pat. No. 6,517,433 B2, U.S. Patent Application Pub. Nos. US 2010/0069160 A1 and US 2010/0234099 A1, and International Application No. PCT/US2007/000792, all of which are incorporated herein by reference in their respective entireties and for all purposes.

The gaming terminal 10 illustrated in FIG. 1 comprises a cabinet 11 that may house various input devices, output devices, and input/output devices. By way of non-limiting example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display may be disposed in front of the mechanical-reel display to portray a video image superimposed upon the mechanical-reel display. A video display is, in various embodiments, a cathode ray tube (CRT), a high-resolution liquid crystal display (LCD), a plasma display, a light emitting diode (LED), a Digital Light Processing (DLP) projection display, an electroluminescent (EL) panel, or any other type of display suitable for use in the gaming terminal 10. The display areas may variously display information associated with wagering games, non-wagering games, community games, progressive games, advertisements, services, premium entertainment, text messaging, emails, alerts, announcements, broadcast information, subscription information, etc., appropriate to the particular mode(s) of operation of the gaming terminal 10. The gaming terminal 10 includes a touch screen(s) 18 mounted over the primary and/or secondary areas 12, 14, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present disclosure.

Video images in the primary display area 14 and/or the secondary display area 16 can be rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable). Such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals can be selected from a group consisting essentially of an electrical current, an electrical voltage, an electrical charge, an optical signal, an optical element, a magnetic signal, and a magnetic element.

Figure 2:
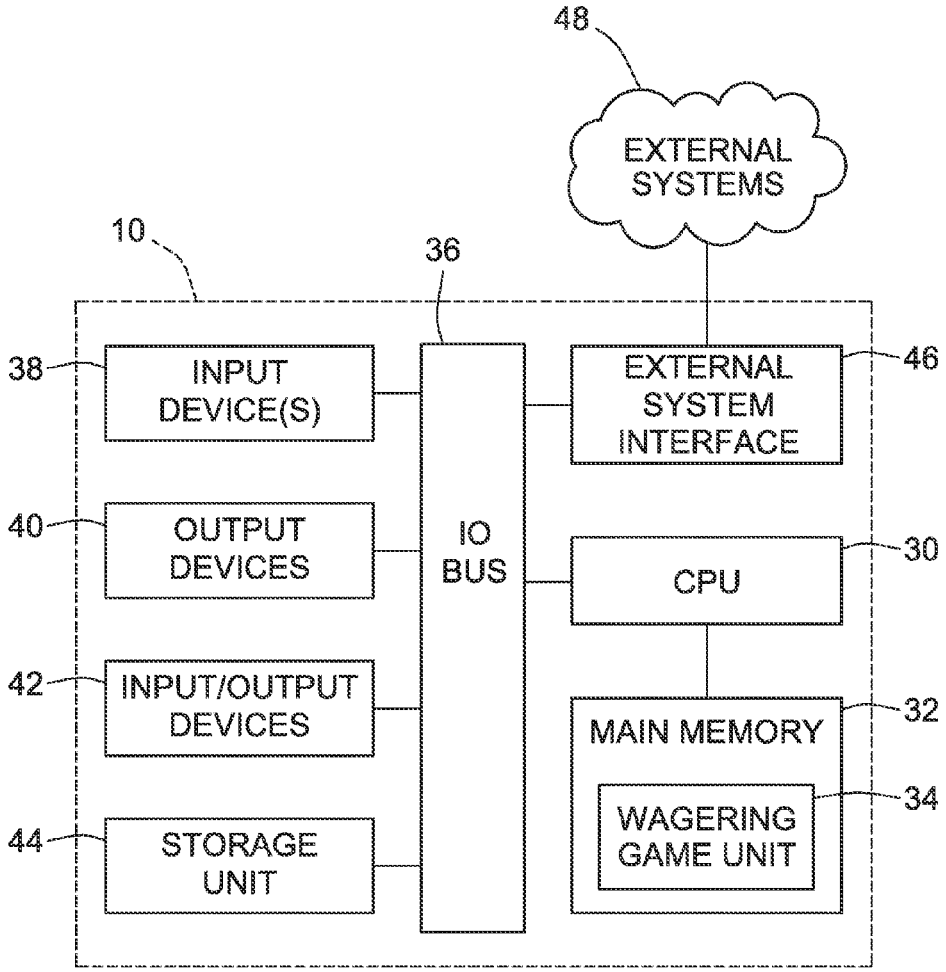
FIG. 2 is a schematic diagram of an example of a gaming machine in a representative gaming system according to aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by INTEL® and AMD®. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum radio-frequency (RF) signals (e.g., Bluetooth, etc.).

The gaming terminal 10 optionally communicates with the external system 48 such that the terminal operates as a thin, thick, or intermediate client. In general, a wagering game includes a random number generator (RNG) for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
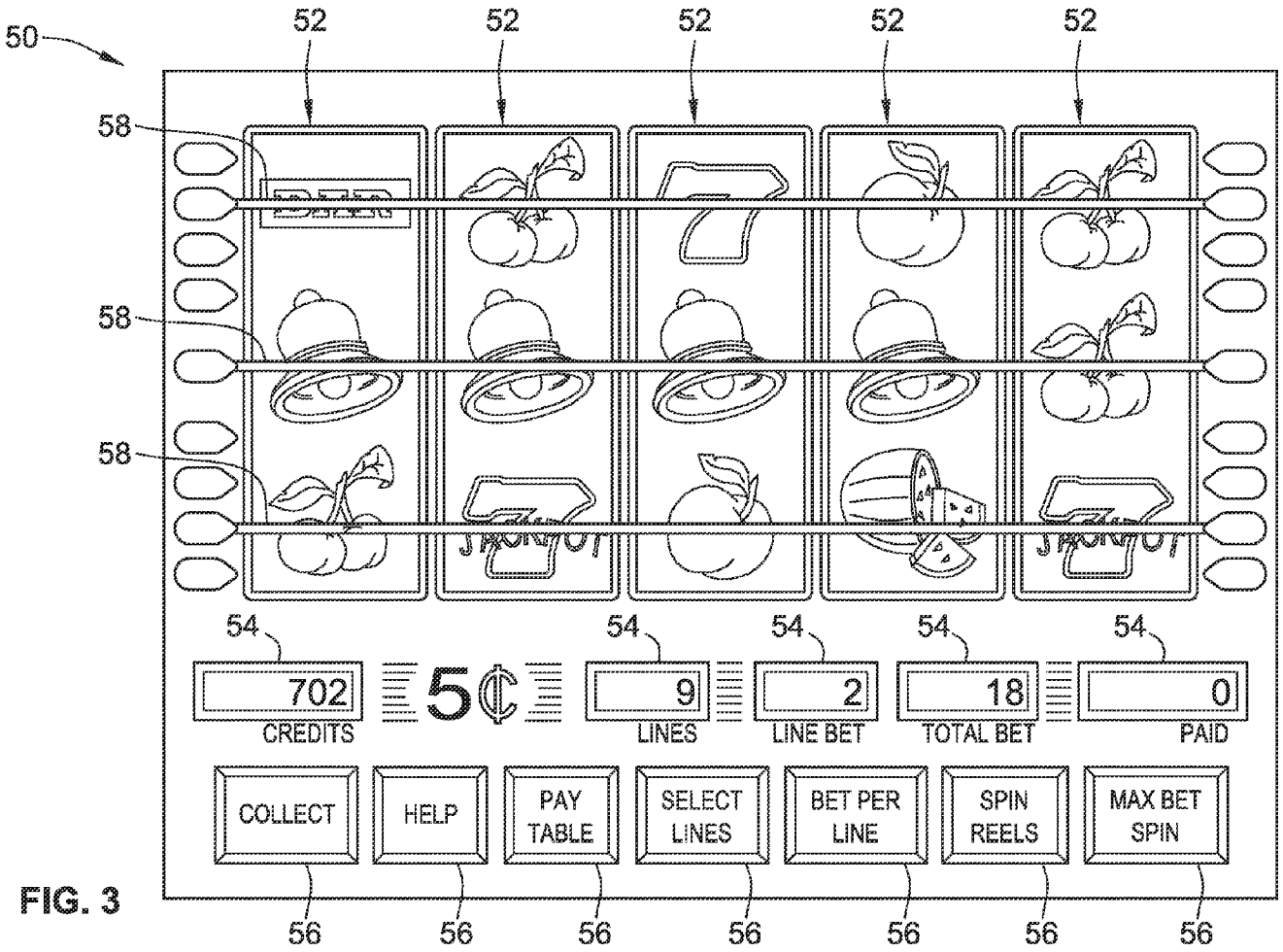
FIG. 3 is a screen shot of an example of a basic-game screen of a wagering game displayed on a gaming terminal, gaming device, and/or gaming system according to aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by an RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
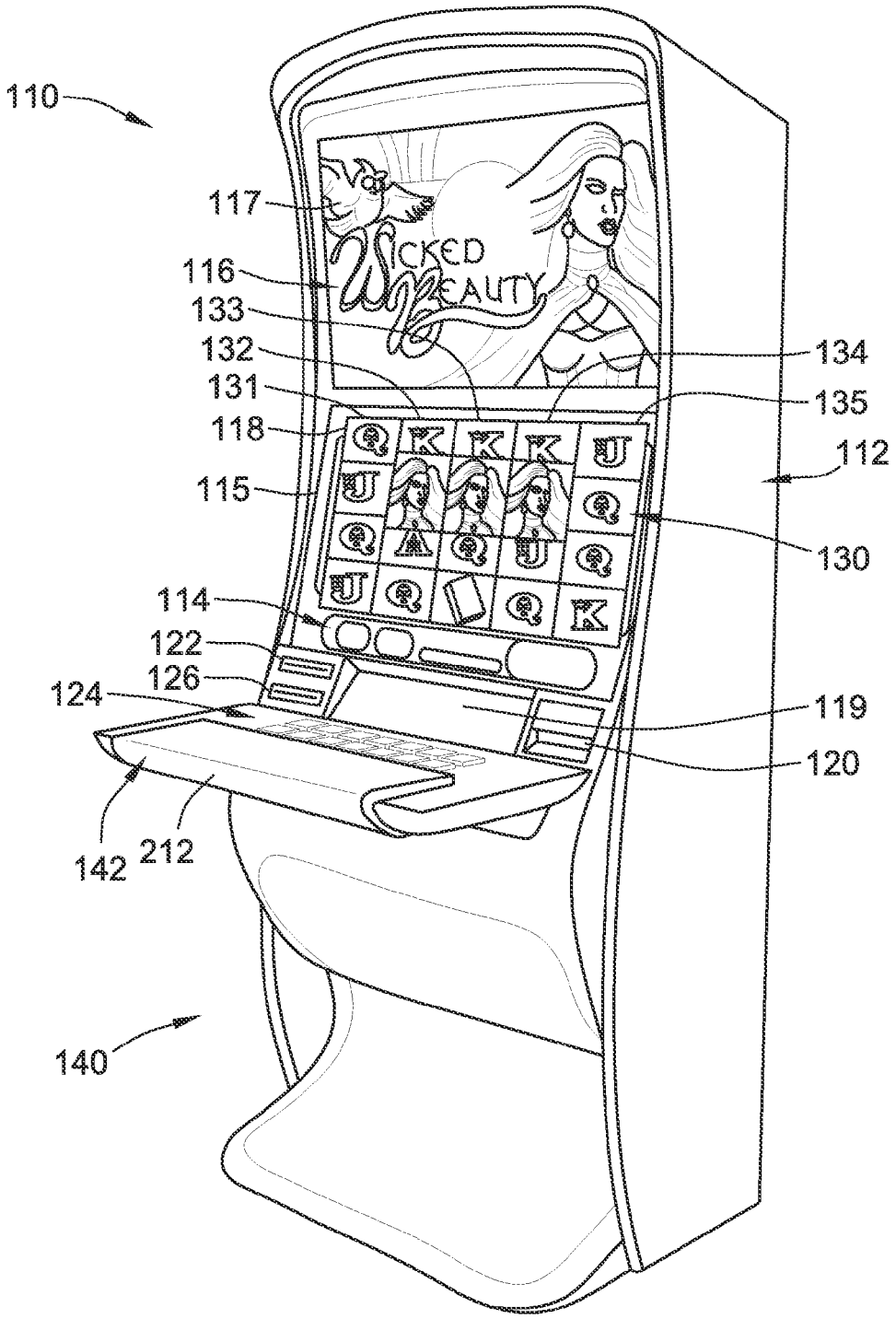
FIG. 4 is a perspective-view illustration of a representative modular free-standing gaming terminal in accordance with aspects of the present disclosure.

FIG. 4 illustrates a representative modular free-standing gaming terminal, designated generally at 110, according to aspects of the present disclosure. Although differing in appearance, the gaming terminal 110 can be similar in function, operation and connectivity to the gaming terminal 10 discussed above with respect to FIGS. 1 and 2 and, thus, can include any of the options, features and alternatives described above. For example, the gaming terminal 110 (also referred to herein as "wagering game machine" or "gaming machine") may be an electromechanical gaming terminal configured, for example, to play mechanical slots, or it may be an electronic gaming terminal configured, for example, to play a video casino game, such as keno, poker, slots, blackjack, roulette, etc. Markedly, the gaming terminal 110 is purely representative in nature, and presented solely for explanatory purposes.

The illustrated gaming terminal 110, which is shown as an upright free-standing gaming terminal, comprises a cabinet, designated generally as 112, for housing and/or supporting a variety of operational componentry. For output devices, the gaming terminal 110 includes, among other things, a first "primary" display module 114, and a second "top-box" or "secondary" display module 116. In accord with the embodiment shown in FIG. 4, each display module 114, 116 includes a corresponding display device 115 and 117, respectively, for displaying wagering games, such as those described above with respect to FIGS. 1-3 and/or those described below with respect to FIGS. 4-11, for example. Each display device 115, 117 may be any form of display, such as those described with reference to the free-standing gaming terminal 10 of FIG. 1. For instance, the primary and secondary display devices 115, 117 may comprise plasma, LED, OLED, AMOLED, LCD, CRT, or projection display devices, or any other now-known or later-developed display devices. For some configurations, the primary display device 115 may comprise an edge-lit high-definition (HiDef) LCD display panel or laterally juxtaposed electro-mechanical symbol-bearing slot reels, optionally framed with a transmissive LCD panel, while the secondary display device 117 may comprise an edge-lit HiDef LCD display panel or a top-box display with backlit glass artwork. Optional configurations can include greater or fewer display modules than the two shown in FIG. 4. And, as will be discussed in extensive detail hereinbelow, the display modules 112, 114 may take on various alternative forms, sizes, orientations, etc., and may be replaced with other interchangeable display and accessory modules within the scope and spirit of the present disclosure.

For input devices, the gaming terminal 110 may include one or more touchscreens 118 and 119, a bill receiving and validating device 120, an information reader/writer(s) 122, a button panel 124, and a ticket reader/printer 126, as some non-limiting examples. The gaming terminal 110 may include one or more other/alternative player input and output devices, including trackpads, speech-recognition enabled hardware, a QWERTY keyboard, audio speakers, marquees, and one or more player-accessible ports (e.g., an audio output jack for headphones, a video headset jack, an internet cable jack, a wireless transmitter/receiver, etc.). In the illustrated example, the button panel 124 includes: (1) a row of mechanical wager-selection pushbuttons that allow a player to choose any of a variety of specified wager amounts for each activated payline; and, (2) a row of mechanical payline-selection pushbuttons that allow a player to choose any of a variety of specified payline configurations prior to spinning the reels. While these typical components found in the gaming terminal 110 are described above, it should be understood that numerous additional/alternative peripheral devices and other elements may exist or be hereafter developed that may be used in any number of combinations to create various forms of a gaming terminal.

The gaming terminal 110 may communicate with an external or central gaming system (e.g., external system 48 of FIG. 2) in a wired or wireless manner such that each terminal operates as a "thin client" having relatively less functionality, a "thick client" having relatively more functionality, or as a "rich client" with any range of functionality therebetween. As a generally "thin client," the gaming machine may operate primarily as a player-input device to receive player wagers and game-related inputs and as a display device to display the results of gaming outcomes processed externally, for example, on a server as part of the external systems 48. In this "thin client" configuration, a remote server executes game code and determines game outcomes (e.g., with a random number generator), while an on-board controller of the gaming machine processes display information to be displayed on the display device(s) of the machine. In an alternative "thicker client" configuration, a remote server determines game outcomes, while an on-board controller of the gaming machine executes game code and processes display information to be displayed on the display device(s) of the machines. In yet another alternative "thick client" configuration, an on-board controller of the gaming machine 110 executes game code, determines game outcomes, and processes display information to be displayed on the display device(s) of the machine. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 110 ("thick client" gaming terminal), the external/central gaming system ("thin client" gaming terminal), or distributed therebetween in any suitable manner ("rich client" gaming terminal). The gaming terminal 110 may also communicate with a player or a front-end system, e.g., using Near Field Communication (NFC), Radio-Frequency Identification (RFID), Bluetooth, or similar short range devices.

A first "primary" display device 115 of the primary display module 114 is operable, alone or in cooperation with a second "top-box" display device 117 of the secondary display module 116, to display or otherwise visually depict a wagering game 130, which in this example is a reel-type "slot" wagering game. The slot game 130 includes a plurality of symbol-bearing reels, designated as 131-135 in FIG. 4, each having a plurality of distinct reel positions occupied by a number of game-related symbols. The reels 131-135 displayed on the primary display device 115 may be electro-mechanical reels, computer-generated simulations of mechanical slot reels, other replicated forms of reels, or any variation or combination thereof. The symbols borne by these reels may include any variety of graphical symbols, emblems, elements, or representations, including symbols that are associated with one or more themes of the gaming terminal 110 (e.g., a WICKED BEAUTY theme). The reel positions may also include blank symbols or empty spaces.

The symbols on the reels 131-135, when part of a wagering-game outcome, are arranged in a symbol array, which in this embodiment is a 4×5 matrix—four rows by five columns—of distinct array positions (20 total array positions in FIG. 4). The reels 131-135 are varied (e.g., spun and stopped) to reveal combinations of symbols, which represent randomly selected outcomes of the wagering game 130, that are evaluated for winning symbol combinations. Winning combinations of symbols landing, for example, on activated paylines (e.g., those paylines for which a wager has been received) which extend through the array positions cause awards to be paid in accordance with one or more pay tables associated with the wagering game 130. In some embodiments, winning combinations of symbols include three or more like symbols aligned adjacent one another on an active pay line (e.g., left-to-right configuration, right-to-left configuration, or both). In some embodiments, symbol combinations are evaluated in accord with various other schemes such as, but not limited to, scatter pays.

Within the scope of this disclosure, the wagering game 130 can include greater or fewer than five symbol-bearing reels (simulated, mechanical, or otherwise), each of which may include greater or fewer reel positions and reel symbols than those described with respect to FIG. 4. In alternate embodiments, the randomly selected outcomes may comprise greater or fewer than 20 symbols, and may take on a variety of different forms having greater or fewer rows and/or columns. The array 130 may even comprise other non-rectangular forms or arrangements of symbols. Moreover, the randomly selected outcomes of the wagering game 130 may be varied from the representation provided in FIG. 4. Although numerous aspects of the wagering game 130 are all shown displayed on a single display device, namely the primary display device 115, these aspects are not so limited and can be displayed in any combination on any number of display devices unless otherwise expressly prohibited.

Disclosed in FIGS. 4-11 are wagering game systems and machines with various modular gaming terminal configurations, options, and features. The modular gaming terminal 110 of FIG. 4, for example, includes three modules: a first "primary" display module 114, a second "top-box" or "secondary" display module 116, and a "universal" core module 140. An optional fourth module may comprise a player input (or "button deck") module 142. Modular gaming terminal configurations of the present disclosure may include additional or fewer or alternative modules to that which are shown in the drawings. Traditional prior art gaming terminal configurations employ a single unitary cabinet which acts as the terminal's sole outer housing to which the various pieces of functional hardware are attached and/or enclosed. In contrast, the modular gaming terminal 110 of FIG. 4 offers flexible and changeable cabinet configurations by segmenting the cabinet's componentry into functional sections (e.g., display, control, input, etc.), and partitioning those sections into connectable units (e.g., display module(s), control module(s), input module(s), etc.). In this regard, each of the modules—e.g., the two display modules 114, 116, the core module 140, and the player input module 142—are physically distinct units that are selectively separable from one another without having to disassemble or physically damage any of the modules. By way of example, and not limitation, each of the illustrated modules has a respective support housing to which is mounted the functional hardware for that module; the discrete housings and functional components are physically and electrically connectable (and disconnectable) to provide a fully functional wagering game machine (and to change the appearance and configuration of the machine).

Figure 5:
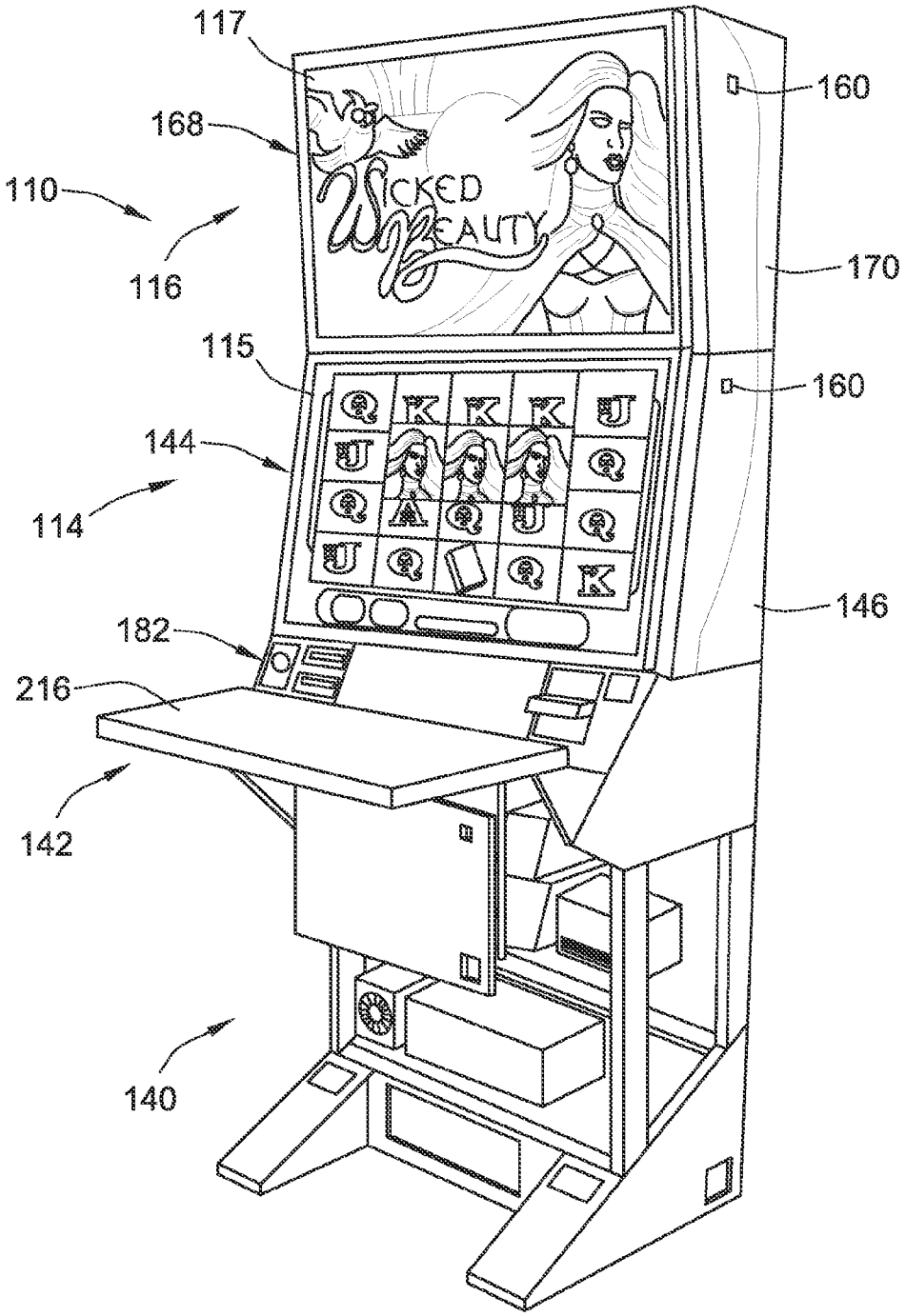
FIG. 5 is another perspective-view illustration of the representative modular gaming terminal of FIG. 4 shown with the outer facia paneling and trim structure removed to better illustrate the underlying (universal) core module, first (primary) display module, and second (top-box or secondary) display module.
Figure 6:
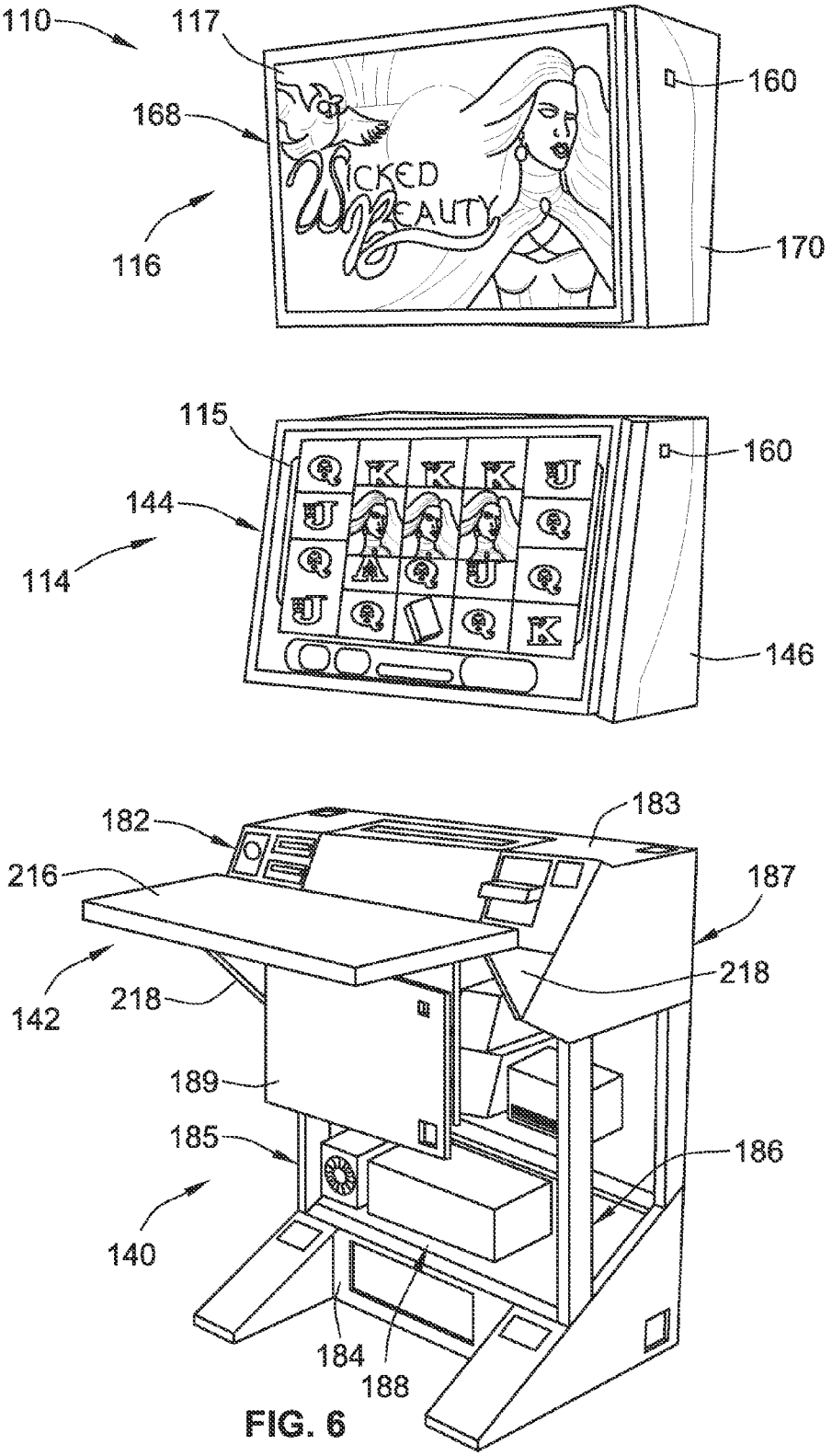
FIG. 6 is a partially exploded perspective-view illustration of the modular gaming terminal of FIG. 4 showing each of the modules illustrated in FIG. 5 as a physically distinct, selectively separable unit.
Figure 8:
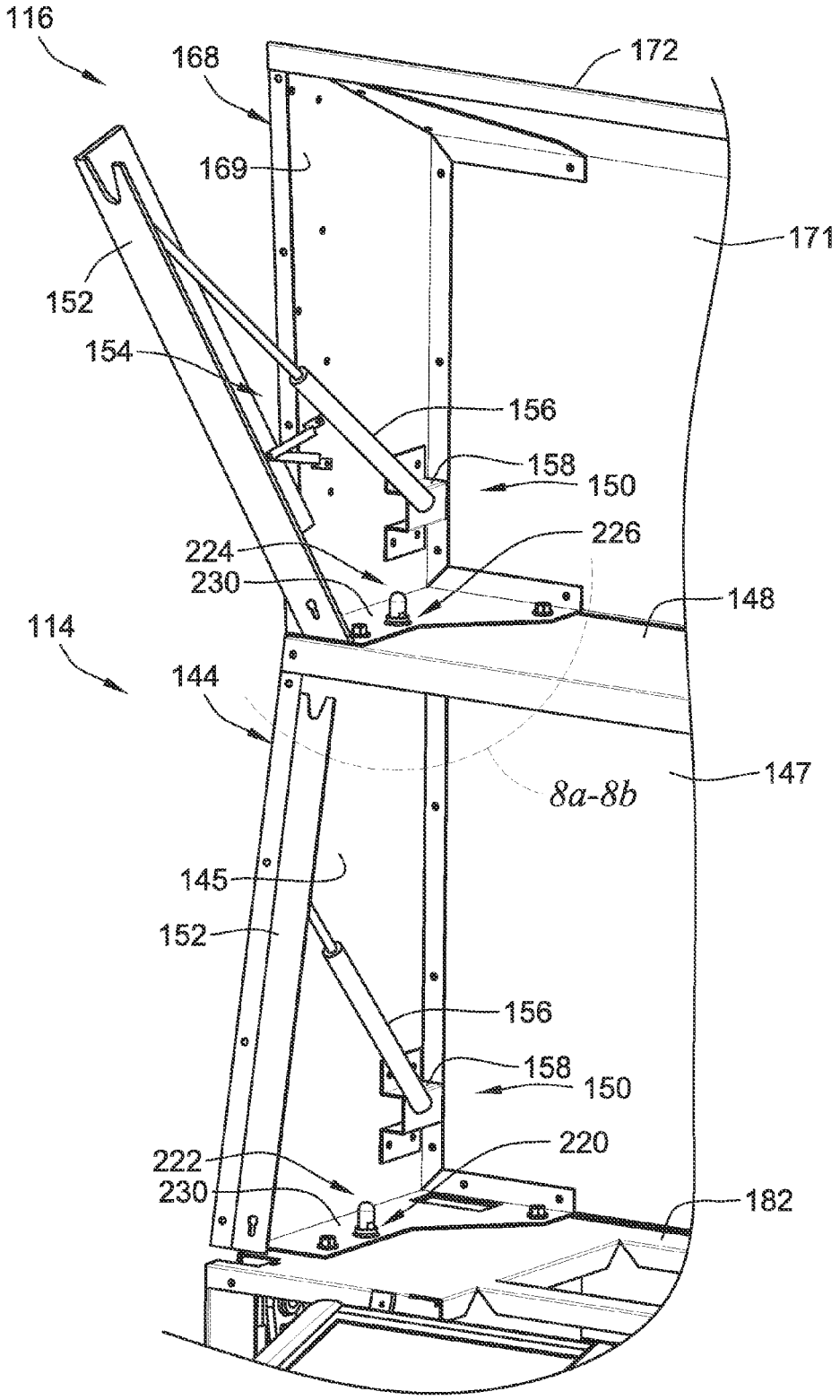
FIG. 8 is an enlarged perspective-view illustration of the primary display module and the secondary display module of FIG. 4 with the corresponding video display panels removed to better illustrate some of the componentry stowed inside the respective display modules.

With reference now to FIGS. 6 and 8, the first display module 114 includes a first display device 115, shown in the drawings as a flat-screen edge-lit HiDef LCD video display panel that is operable to dynamically display randomly selected outcomes and other related features of the wagering game 130. The first display device 115 is cantilevered via a pivot-hinge subassembly 150 to the front of a first display housing 144. The display housing 144 includes a rigid (e.g., metallic) frame comprising opposing, laterally spaced and generally parallel sidewalls 145 and 146 that are interconnected by a back wall 147 and a top wall 148, which extend between the sidewalls 145, 146 and are generally orthogonal to one another. The first display pivot-hinge subassembly 150 is a compound hinge that allows the LCD display panel of the first display device 115 to pivot forward and backward about a bottom edge thereof between a generally oblique (maintenance) orientation and a generally vertical (operational) orientation. As shown, each display pivot-hinge subassembly 150 includes a pair of laterally spaced L-shaped latching brackets 152 (only one from each subassembly is visible in FIG. 8). Each L-shaped latching bracket 152 is pivotably attached at a bottom end thereof to a respective one of the frame's sidewalls 145, 146 via a dual-arm compound hinge 154. A corresponding motion-damping air cylinder 156 (one from each subassembly is visible in FIG. 8), which is rotatably mounted via a U-shaped bracket 158 to one of the sidewalls 145, 146 of the housing frame 144, is coupled to the L-shaped latching bracket 152 to help regulate the movement of the display device 115 when pivoting forward and backward. An optional display latch subassembly 160 (FIGS. 5 and 6), which is mounted to and extends partially through the right sidewall 146 of the display housing frame 144, includes a gravity-fed lock with a lever or other release mechanism for locking the LCD display panel of the first display device 115 in, and selectively releasing the LCD display panel from, the generally vertical (operational) orientation.

Figure 7:
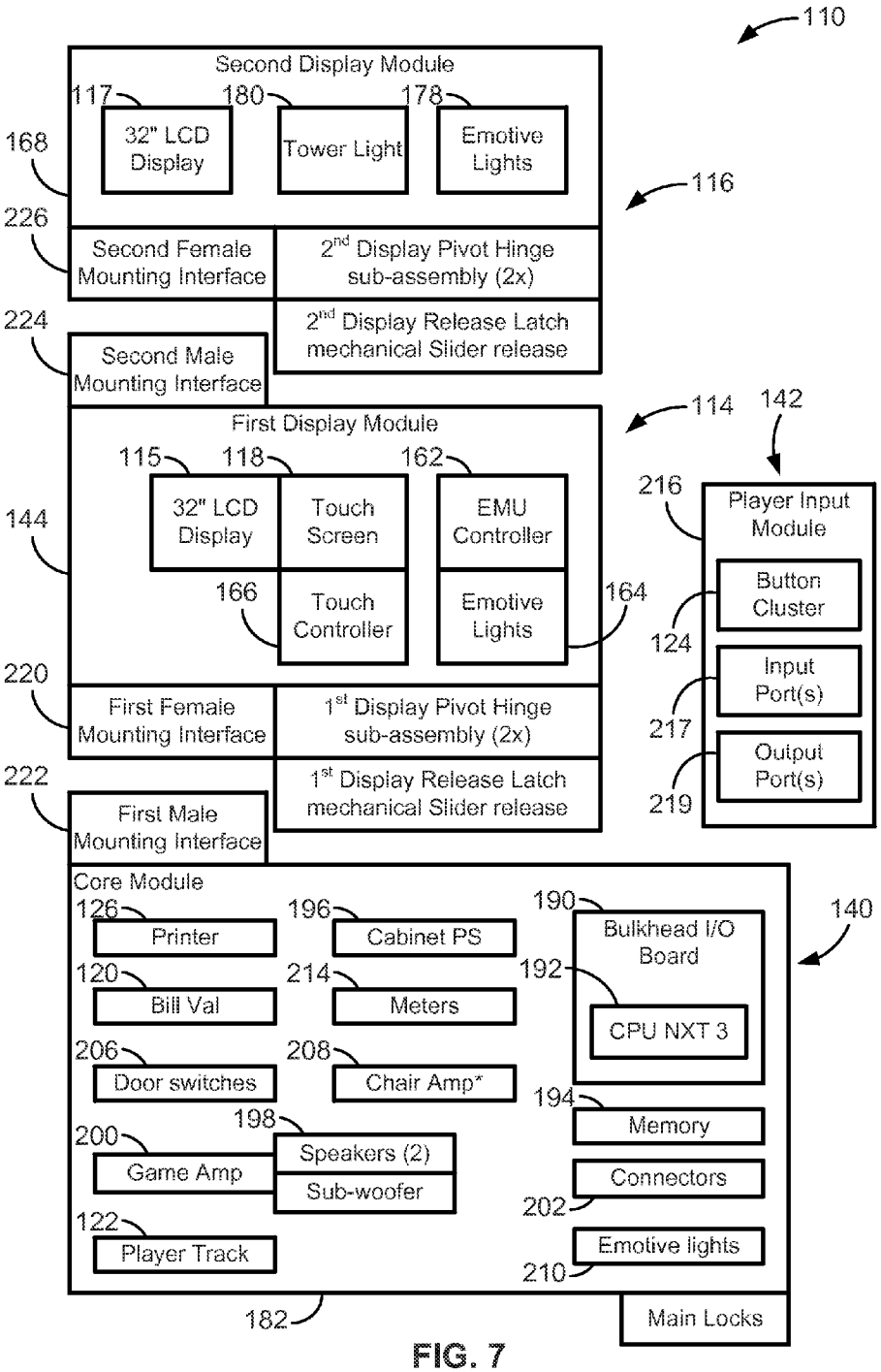
FIG. 7 is a schematic diagram of the modular gaming terminal of FIG. 4.

As seen in FIG. 7, stowed within the housing 144 of the first display module 114 is an EMU Controller 162 for controlling an emotive lighting assembly 164 disposed on the forward-facing perimeter of the module 114. Overlaying the forward-facing surface of the LCD display panel of the first display device 115 is a touchscreen 118 (e.g., a resistive or capacitive multi-layer touchscreen panel) that is operatively coupled to and controlled by a Touch Controller 166. As indicated above, the touchscreen 118 operates as a player input device to receive, for example, wager inputs and/or game-related selections from a player during play of the wagering game 130. It should be understood that numerous additional/alternative peripheral devices and other elements may be incorporated in any number of combinations into the display module 114 to create various forms of a gaming terminal.

Similar to the first display module 114, the second display module 116 includes a display device 117, which may also be in the nature of a flat-screen edge-lit HiDef LCD video display panel for displaying features and aspects of the wagering game 130, such as bonus games, community games, progressive games, advertisements, game-related information, etc. The second display device 117, like the first display device 115, is cantilevered via a pivot-hinge subassembly 150 to the front of a second display housing 168. While differing in overall shape and size, the two display housings may be similar in material and construction. For instance, the housing 168 of the second display module 116 includes a rigid (e.g., metallic) frame comprising opposing, laterally spaced and generally parallel sidewalls 169 and 170 that are interconnected by a back wall 171 and a top wall 172. The back and top walls 171, 172, which extend between and connect to the two sidewalls 169, 170 of the frame (e.g., via rivets), are coupled together (e.g., via rivets) in a generally orthogonal manner. The second display pivot-hinge subassembly 150 of the second display module 114 can be structurally identical to the first display pivot-hinge subassembly 150 described above with respect to the first display module 114; as such, for brevity and conciseness, a duplicated description of the second display pivot-hinge subassembly 150 will be omitted. In a similar regard, the first display module 114 may further comprise an optional display latch subassembly 160, which may be structurally identical to the latch subassembly 160 described above with respect to the first display module 114 in FIGS. 5 and 6, for locking the LCD display panel of the second display device 117 in, and selectively releasing the LCD display panel from, a generally vertical (operational) orientation.

Turning again to FIG. 7, mounted to the housing 168 of the second display module 114 is a multi-color tower light (or "slot machine candle") 176 and a second emotive lighting assembly 178, which is positioned on the forward-facing perimeter of the module 116. As is well known in the gaming industry, the tower light 176 is provided to comply with local gaming regulations to effectively communicate the status and error conditions, if any, of the gaming machine 110. Once the two display modules 114, 116 are properly mounted, as described in further detail below, the EMU Controller 162 can be operatively coupled to and control operation of the second emotive lighting assembly 178. The emotive lighting assemblies 164, 178 cooperate to enhance the overall gaming environment and, optionally, to attract new players. The emotive lighting can be used to attract players to the gaming machine from a distance with colored light shows including, for example, coordinated light shows across a bank or banks of gaming terminals. The emotive lighting assemblies 164, 178 can also be used, for example, to heighten anticipation during game play by using colors and synchronous lighting displays for conveying emotion and drama, and to celebrate wins during a bonus round or an award. It should be understood that numerous additional/alternative peripheral devices and other elements may be incorporated in any number of combinations into the display module 116 to create various forms of a gaming terminal.

The core module 140 of the modular gaming terminal 110 can be "universal" in that it is configured to receive, couple with, structurally support, and control/power an assortment of interchangeable display and accessory modules, e.g., to provide a variety of distinct gaming machine configurations. In the example illustrated in FIGS. 5 and 6, the core module 140 attaches to, supports, powers, and at least partially controls both the primary and secondary display modules 114, 116. Acting as an internal supporting frame structure, the core module 140 includes a rigid housing 182 that defines a generally closed interior space within which is housed most of the components of the gaming machine 110. As illustrated, the core housing 182 comprises a top 183 interconnected with a base 184 via a pair of opposing and partially open sides 185 and 186, and a partially open back 187 in opposing spaced relation with a partially open front 188. An access door 189, which is mounted to the front 188 of the core housing 182, is movable between a closed position (e.g., FIG. 6), at which access to the interior of the core housing 182 through the front of the core module 140 is generally prevented, and an open position, at which access to the interior of the core housing 182 is allowed. Although alternative shapes are certainly envisioned as being within the scope of the present disclosure, the core housing 182 of FIGS. 5 and 6 is portrayed as having a generally polyhedral geometry with two generally rectangular side faces, two generally rectangular top and bottom faces, and two generally rectangular front and back faces. As illustrated in FIG. 5, the width of the core housing 182 from left side 185 to right side 186 may be approximately the same as the width of the first and second display housings 144, 168. In so doing, when the display modules 114, 116 are mounted onto the core module 140 in the manner illustrated, the terminal 110 outwardly appears to be a single unit.

For some implementations, the core module 140 acts as a localized "brain" and "power center" for the entire gaming terminal 110. Included within the core module 140 is a "Bulkhead" input/output (I/O) bus board 190 (also referred to herein as "electrical bus") that electrically connects the various control devices, input devices, output devices, input/output devices and, in some implementations, power devices of the gaming terminal 110. Acting as a local bus or an internal bus, the Bulkhead Board 190 provides a communication interface for transferring data between the electronic components inside the gaming terminal 110. Also stowed inside the housing 182 of the core module 140 with the electrical bus 190 is a central processing unit (illustrated as "CPU NXT 3") 192 that electrically connects to and controls the display devices 115, 117 of the display modules 114, 116 via the electrical bus 190. The CPU 192 shown in FIG. 7 may take on any of the configurations and options described above with respect to the CPU 30 of FIG. 2, and thus may comprise any suitable hardware, software, controllers and processors, singly and in combination, and may be connected to a localized memory device 194, and further may communicate with and control the transfer of data between the gaming terminal 110 and an external gaming network. The core module 140 further comprises an electrical power regulation unit (illustrated as "Cabinet PS") 196 stowed inside the core housing 182. The power regulation unit 196 includes a series of circuits with board-mounted connectors on the Bulkhead Board 190 which provide multiple power outputs from a single convenient location for ease of access and to reduce the number of cable runs directly to the external power-supply. The power regulation unit 196 can include any suitable interface, such as surface-contact charging pads, pins, sockets, inductive charging components, etc., for delivering power from a wall socket or other suitable power source to mounted display and accessory modules.

With continuing reference to FIG. 7, the core module 140 includes numerous additional and, in some instances, optional hardware and related peripheral devices. This may comprise, in some non-limiting examples, a speaker package 198 with a subwoofer and high- and mid-range speakers that are powered by an electronic "Game Amp" power amplifier 200. Also stowed by the core housing 182 of FIG. 7 are a bill receiving and validating device (or "Bill Val") 120, an information reader/writer device (or "Player Track") 122, and a ticket reader/printer (or "Printer") 126, all of which are mounted such that corresponding input/output slots thereof are accessible through the front face 188 of the core module 140, as seen in FIG. 4. Some product propositions may require operating the gaming terminal 110 with an adjacent gaming chair (not shown), such as those described in commonly owned U.S. Patent Appl. Pub. Nos. 2012/0315985 A1, 2012/0115589 A1, 2011/0111847 A1 and 2008/0211276 A1, all of which are incorporated herein by reference in their respective entireties and for all purposes. For such implementations, the core module 140 includes an optional electronic "Chair Amp" power amplifier 208 for supplying power to the gaming chair. In some embodiments, the CPU 192 is also connected to and controls operation of the gaming chair.

Continuing with the above example, the core module 140 may further comprise a variety of different Meters 214 for measuring game-related data, such as player wagering activity, time on device, occupancy data, payout activity, etc., and non-game-related data, such as error conditions and fault events. Door switches 206 may include a number of discrete micro switches and mounting harnesses for verifying the state (closed or open) of various access doors of the gaming terminal 110. A third emotive lighting assembly 210, which is positioned on the forward-facing perimeter of the core module 110, may be operated in conjunction with the first and second emotive lighting assemblies 164, 178 of the first and second display modules 114, 116 to provide light shows and any of the lighting options described above. Like the gaming terminal 10 of FIGS. 1 and 2, the gaming terminal 110 may include additional or alternative peripheral devices and may include more than one of each component shown in FIG. 7. For some embodiments, the core module 140 is characterized by a lack of a display device for displaying outcomes of the wagering game. In a similar regard, the first and second display modules 114, 116 can each be characterized by a lack of an externally mounted power connecter for electrically powering their corresponding display devices. Moreover, some implementations may require the first and second display modules 114, 116 be characterized by a lack of an internally mounted processing unit for controlling operation of the display devices 115, 117.

The core module 140 and, namely, the CPU 192 and power regulation unit 196 are detachably electrically connectable to the first and second display modules 114, 116 via one or more electrical Connectors 202. These Connectors 202, which are coupled to the Bulkhead I/O Board electrical bus 190, may comprise, in any combination, 12V or 24V power cables for powering the display devices 115, 117, touchscreen 118, emotive lighting assemblies 164, 178, and tower light 180, as well as Digital Visual Interface (DVI) or DisplayPort connectors for controlling the display devices 115, 117, and one or more Universal Serial Bus (USB) connectors for powering and controlling a touchscreen 118. Alternative configurations may include additional/alternative electrical connectors, such as one or more emotive lighting RJ-45 connectors, video (VGA) jacks, Molex™ 6-pin tower connectors, DVI-to-VGA connectors, blind-mate connectors, pigtail connectors, or any now known or hereinafter developed connectors that are logically amenable to the intended use thereof. While these connectors can be provided as separate, individually attachable and detachable connectors, they can be combined into a single "umbilical" connector or an electrical connector bundle. It may be desirable, for some implementations, that the Connectors 202 extend out of the top face 183 of the core housing 140 and, for the secondary display module 116, pass from the core module 140 through the primary display module 114.

Referring again to FIG. 6, the player input module 142 includes an input module housing 208 with a first input device, which is shown in FIG. 4 of the drawings as a button panel 124 that is mounted to the input module housing 216. As described above, the input device 210 can receive wager inputs and other game-related inputs from players to play the wagering game 130. Some examples of button panel features and configurations that can be incorporated into the player input module 142 are disclosed in commonly owned U.S. Patent Application Pub. Nos. 2013/0079157 A1 and 2006/0189387 A1, both of which are incorporated herein by reference in their respective entireties and for all purposes. The input module housing 216 is a rigid (e.g., metallic) tray that may be overmolded or otherwise covered with an armrest support padding 212 (FIG. 14) and assorted trim elements. The input module housing 216 may be pivotably mounted to the core housing 182 by a pair of laterally offset pivot mounting brackets 218. As seen in FIG. 7, the player input module 142 also includes player-accessible input port(s) 217 and output port(s) 219.

Both of the display modules 114 and 116 are removably attached to the core module 140 such that the display modules 114 and 116 may be readily removed from the gaming terminal 110 and, if needed, repaired and/or replaced without having to replace the entire gaming terminal 110 and without having to disassemble or physically damage any of the modules 114, 116, 140. In accord with the illustrated embodiment, the housing of each module includes a male mounting interface, a female mounting interface, or at least one male and at least one female mounting interface. As seen in FIG. 7 of the drawings, for example, mounted on, formed with, or otherwise integrated into the housing 144 of the first display module 114 is a first female mounting interface 220 which is designed to mate with a corresponding first male mounting interface 222 that is mounted on, formed with, or otherwise integrated into the housing 182 of the core module 140. Likewise, mounted on, formed with, or otherwise integrated into the housing 144 of the first display module 114 is a second male mounting interface 224 which is configured to mate with a corresponding second female mounting interface 226 that is mounted on, formed with, or otherwise integrated into the housing 168 of the second display module 116. While only one first female mounting interface 220 and only one first male mounting interface 222 are visible in FIG. 8, it is desirable for at least some embodiments that the display and core modules 114, 140 each includes another corresponding female and another corresponding male mounting interface, respectively, located at opposite lateral sides of the display and core housings 144, 182. Correspondingly, while there are only one second male mounting interface 224 and only one second female mounting interface 226 visible in FIGS. 8, 8A and 8B, it is desirable for at least some embodiments that the first and second display modules 114, 116 each includes another corresponding male and another corresponding female mounting interface, respectively, located at opposite lateral sides of the display housings 144, 168.

In the illustrated embodiment, all of the male mounting interfaces are structurally similar, while all of the female mounting interfaces are structurally similar. For this reason, and for brevity and conciseness, the structure, operation and functionality of the male and female mounting interfaces will be described with respect to the second male and second female mounting interfaces 224, 226 of the first and second display modules 114, 116. It should be recognized, however, that in alternative embodiments one or more or all of the male and female mounting interfaces may take on a distinctive and alternative design. In some non-limiting examples, each male-and-female mounting interface set may comprise a self-aligning guide rail assembly, a self-aligning twist-and-lock assembly, a self-aligning blind-mate connector assembly, cables and panel-mounted sockets, etc. It is also within the scope of this disclosure to modify the location of each male-and-female mounting interface set (e.g., move each set to a centralized location of the corresponding module housings), or to reverse the relative location of the male and female counterparts (e.g., place the first female mounting interface 220 on the core module 140 and place the first male mounting interface 222 on the first display module housing 144).

Figure 8A:
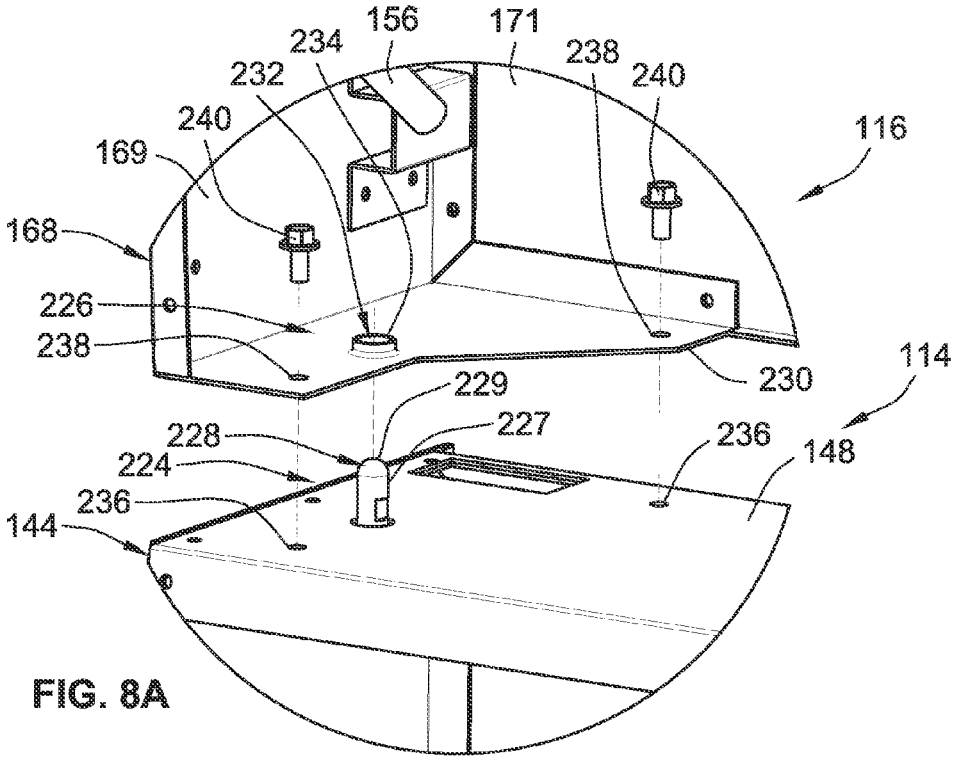
FIGS. 8A and 8B are further enlarged perspective-view illustrations of select portions of the primary display and secondary display modules shown in FIG. 8 to better illustrate self-aligning mechanical mounting interfaces of the display modules.
Figure 8B:
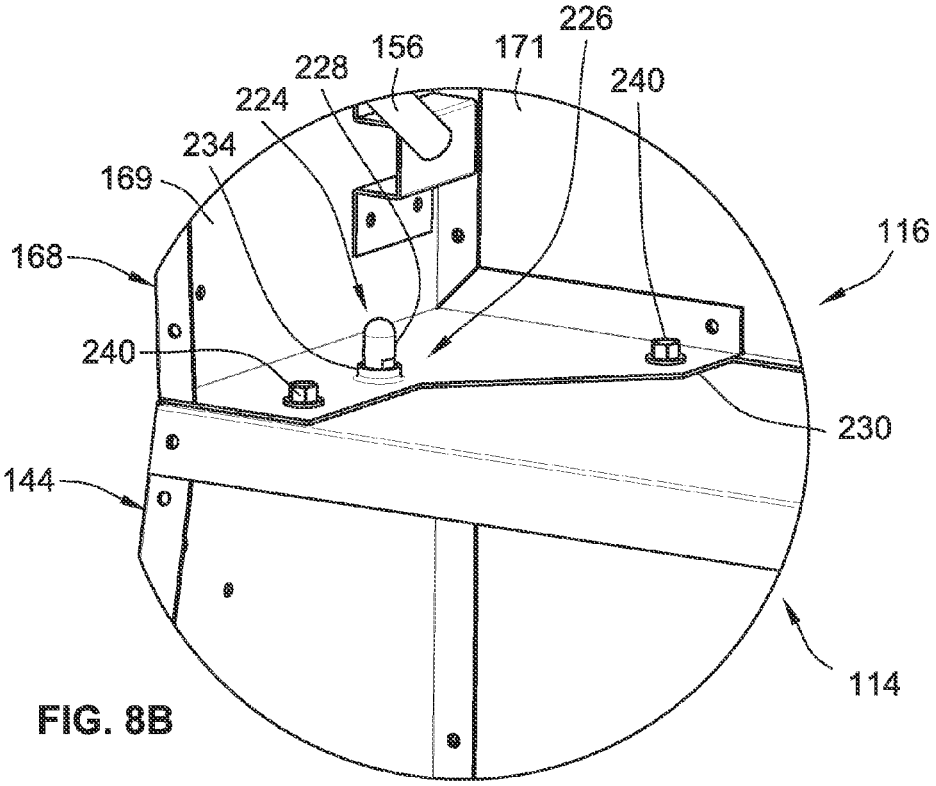

Turning to FIGS. 8A and 8B, each male mounting interface 224 includes a self-locating guide pin 228 which is generally orthogonal with and projects vertically upward from the top wall 148 of the first display housing 144 (or the top face 183 of the core housing 182 for the first male mounting interface 222). According to the illustrated example, the self-locating guide pin 228 includes a cylindrical stem 227 that is attached at a bottom end thereof to the first display housing 144 (or to the core housing 182 for the first male mounting interface 222). Attached to or integrally formed with a top end of the stem 227 is a semispherical cap 229. By contrast, each female mounting interface 226 is structurally configured to receive therein a corresponding male mounting interface 224. In the illustrated example, each female mounting interface 226 includes a circular guide slot 232 that is defined through a base mounting plate 230. The base mounting plate 230 of FIGS. 8A and 8B is attached to and generally orthogonal with the side and back walls 169, 171 of the second display module housing 168 (or the side and back walls 145, 147 of the first display module housing 144 for the first female mounting interface 220). The female mounting interface 226 further includes a frustoconical flange 234 that extends continuously or substantially continuously around the guide slot 232 and projects upwardly from the base mounting plate 230. According to at least the illustrated embodiment, the guide pin 228 and guide slot 232 of the male and female mounting interfaces 224, 226 are both characterized by a lack of helical threads.

With the configurations shown in FIG. 8, each female mounting interface 220, 226 is configured to receive their counterpart male mounting interface 222, 224 such that sliding or otherwise moving the male mounting interface 222, 224 into the female mounting interface 220, 226 operates to automatically align the second display module 116 with the first display module 114 (or automatically align the first display module 114 with the core module 140 when mating the first male and female mounting interfaces 222, 220) and removably attach the first display housing 144 to the second display housing 168 (or removably attach the first housing 144 to the core housing 182). By way of non-limiting example, the self-locating guide pin 228 of FIGS. 8A and 8B projects upwardly from the first display housing 144. An optional alternative design could switch the locations of the guide pin 228 and guide slot 232 such that the guide pin 228 projects downwardly from the second display housing 168. In either instance, when the second display module 116 is positioned over the first display module 114 (or the first display module 114 is positioned over the core module 140 in the case of the first male and female mounting interfaces 222, 220), the guide pin 228 need merely be brought within proximity of the guide slot 232 such that the guide pin cap 228 is located adjacent the guide slot flange 234. Under the weight of the second display module 116 (or the weight of first display module 114 for the first mounting interfaces 222, 220), the contoured face of the semispherical guide pin cap 228 slides against the angled inner-diameter face of the frustaconical flange 234 and thereby automatically coaxially aligns the guide pin 228 with the guide slot 232. Once concentrically aligned with the guide slot 232, the guide pin 228 slides into the guide slot 232 under the weight of the display module 116.

In the illustrated embodiment, moving the second male mounting interface 224 (i.e., the guide pin 228) into the second female mounting interface 226 (i.e., the guide slot 232) operates to automatically align the lateral sidewalls 169, 170 and back wall 171 of the second display housing 168 with the lateral sidewalls 145, 146 and back wall 147, respectively, of the first display housing 144. Additionally, moving the second male mounting interface 224 into the second female mounting interface 226 also operates to automatically position the base mounting plate 230 of the second display housing 168 adjacent and, optionally, against the top wall 148 of the first display housing 144. Likewise, moving the first male mounting interface 222 into the first female mounting interface 220 operates to automatically align the lateral sidewalls 145, 146 and back wall 147 of the first display housing 144 with the sides 185, 186 and back 187, respectively, of the core housing 182. Additionally, moving the first male mounting interface 222 into the first female mounting interface 220 also operates to automatically position the base mounting plate 230 of the first display housing 144 adjacent and, optionally, against the top face 183 of the core housing 182. In instances where the dimensions of the modules do not coincide (e.g., where the housing of one or more of the display modules is wider and/or deeper than the housing of the core module), the automatic alignment between adjacent modules may comprise operatively positioning the base of one module adjacent and, optionally, against the top of the subjacent module such that the modules can be electronically connected.

As seen in FIG. 8A, the housings 144, 168 of each display module 114, 116 also include numerous bolt holes 236 and 238, respectively, that are proximal to the male and female mounting interfaces 224, 226. Specifically, in the illustrated embodiment, the top wall 148 of the first display housing 144 includes two bolt holes 236 that are proximal to the second male mounting interface 224, while the base mounting plate 230 of the second display housing 168 includes two bolt holes 238 that are proximal to the second female mounting interface 226. Although not visible in the views provided, the housings 144, 182 of the first display module 114 and the core module 140, respectively, also include complementary bolt holes that are proximal to the first male and female mounting interfaces 222, 220. In this regard, moving the male mounting interface 222, 224 into the corresponding female mounting interface 220, 226 automatically aligns the bolt holes 236, 238 such that a complementary bolt 240 can be passed through the bolt holes 236, 238, as seen in FIG. 8B. With the configuration shown in FIGS. 8A and 8B, mechanically removably attaching the second display module 116 to the first display module 114 (or mechanically removably attaching the first display module 114 to the core module 140) can consist essentially of: (a) moving the male mounting interfaces into the female mounting interfaces, and (b) securing together the adjacent housings via one or more threaded fasteners. In this regard, mechanically detaching the second display module 116 from the first display module 114 (or mechanically detaching the first display module 114 from the core module 140) can consist essentially of: (a) removing the threaded fasteners, and (b) removing the male mounting interfaces from the female mounting interfaces.

Figure 9A:
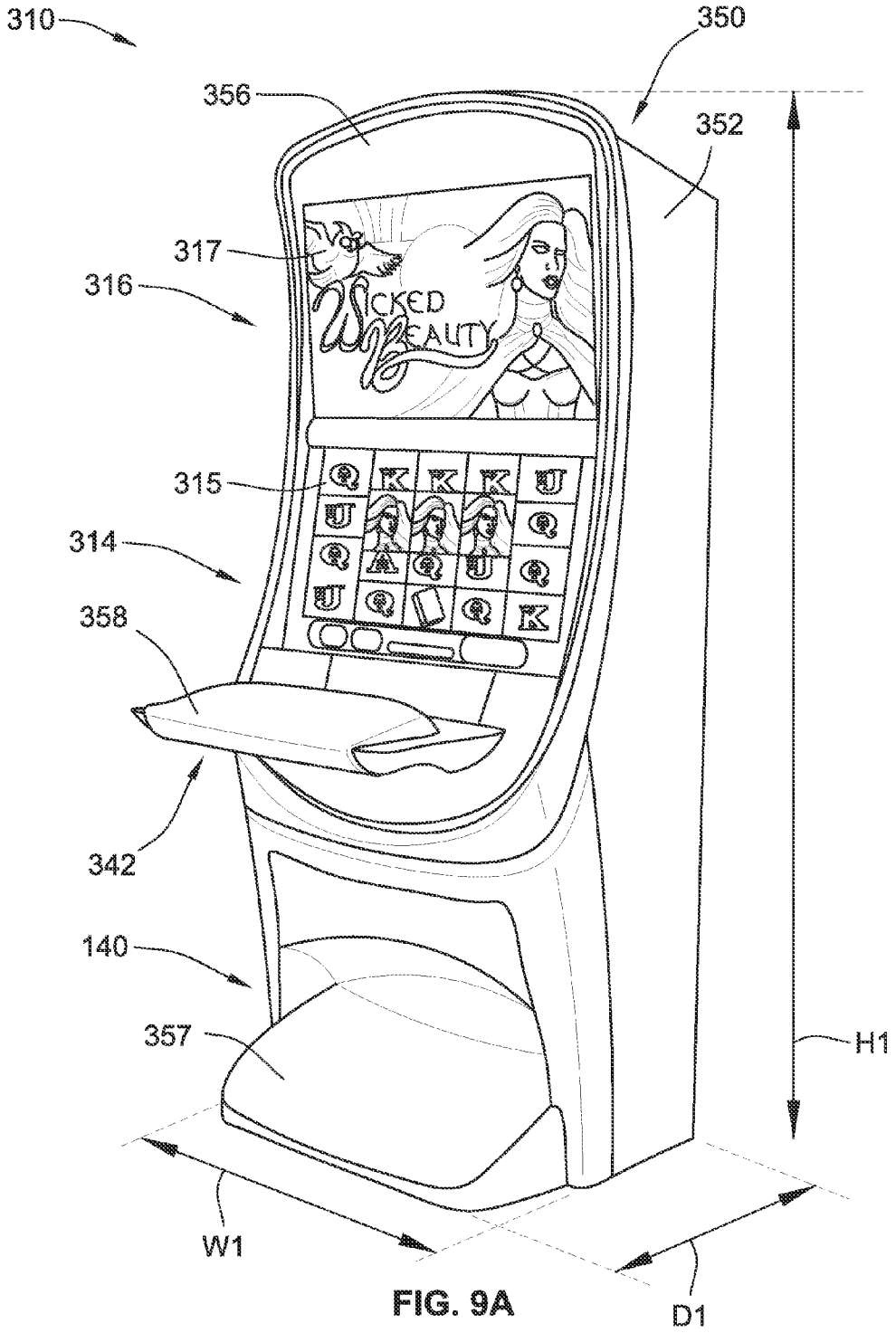
FIGS. 9A-9C are perspective view illustrations of three representative gaming machine configurations with distinct footprints and distinct outer appearances provided by the universal core module of FIG. 4 supporting different combinations of display modules and outer facia paneling and trim structures.
Figure 9B:
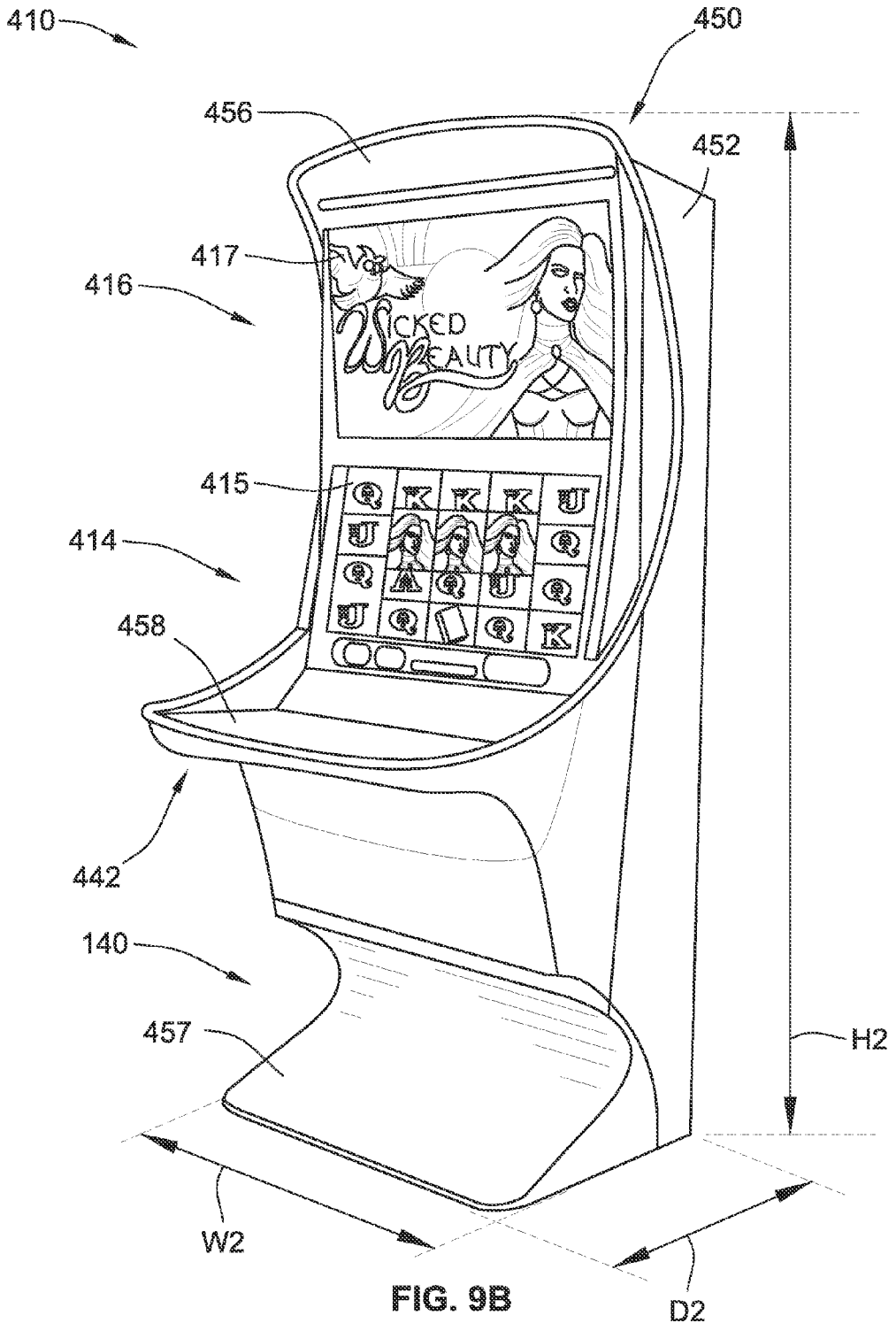
Figure 9C:
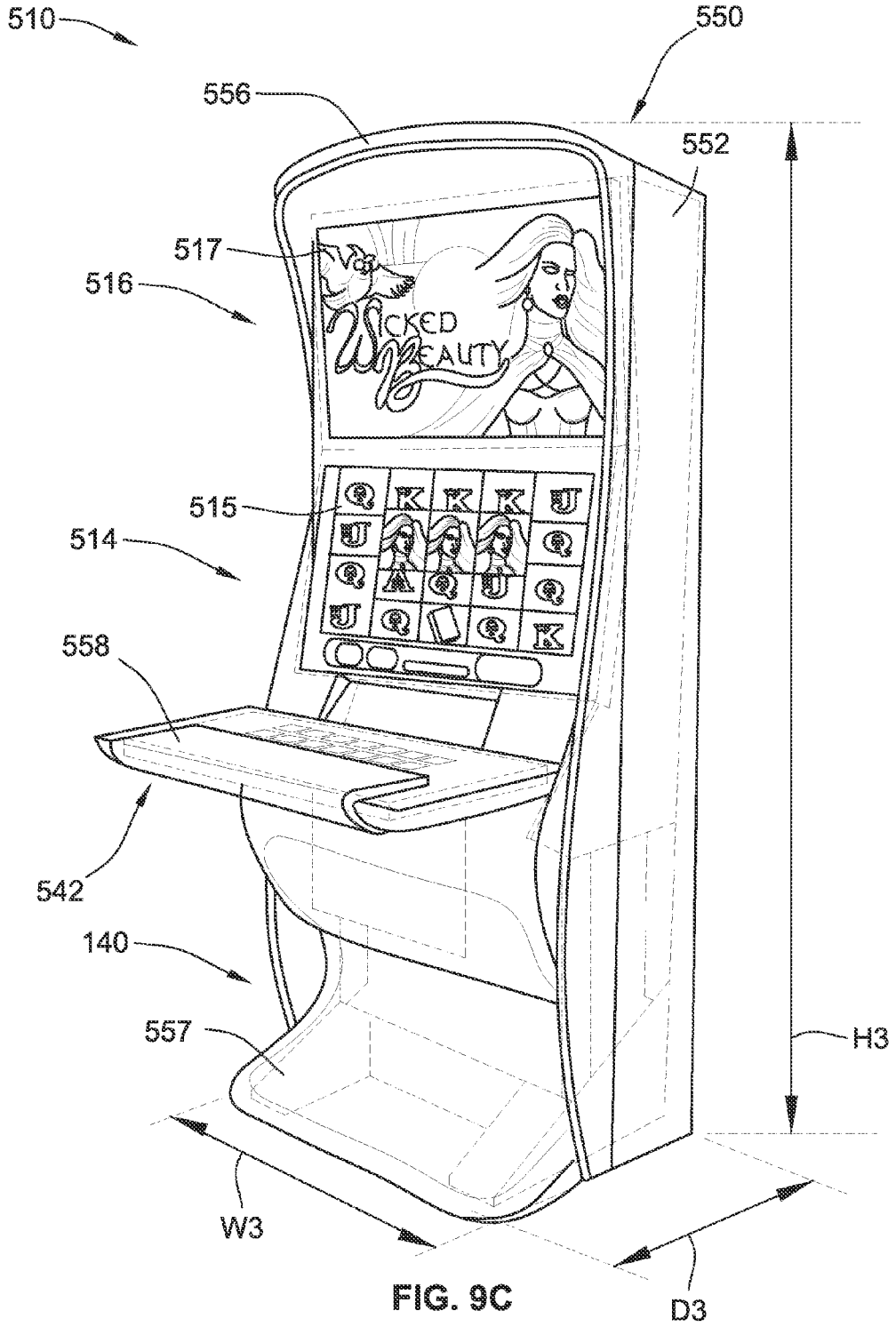
Figure 10:
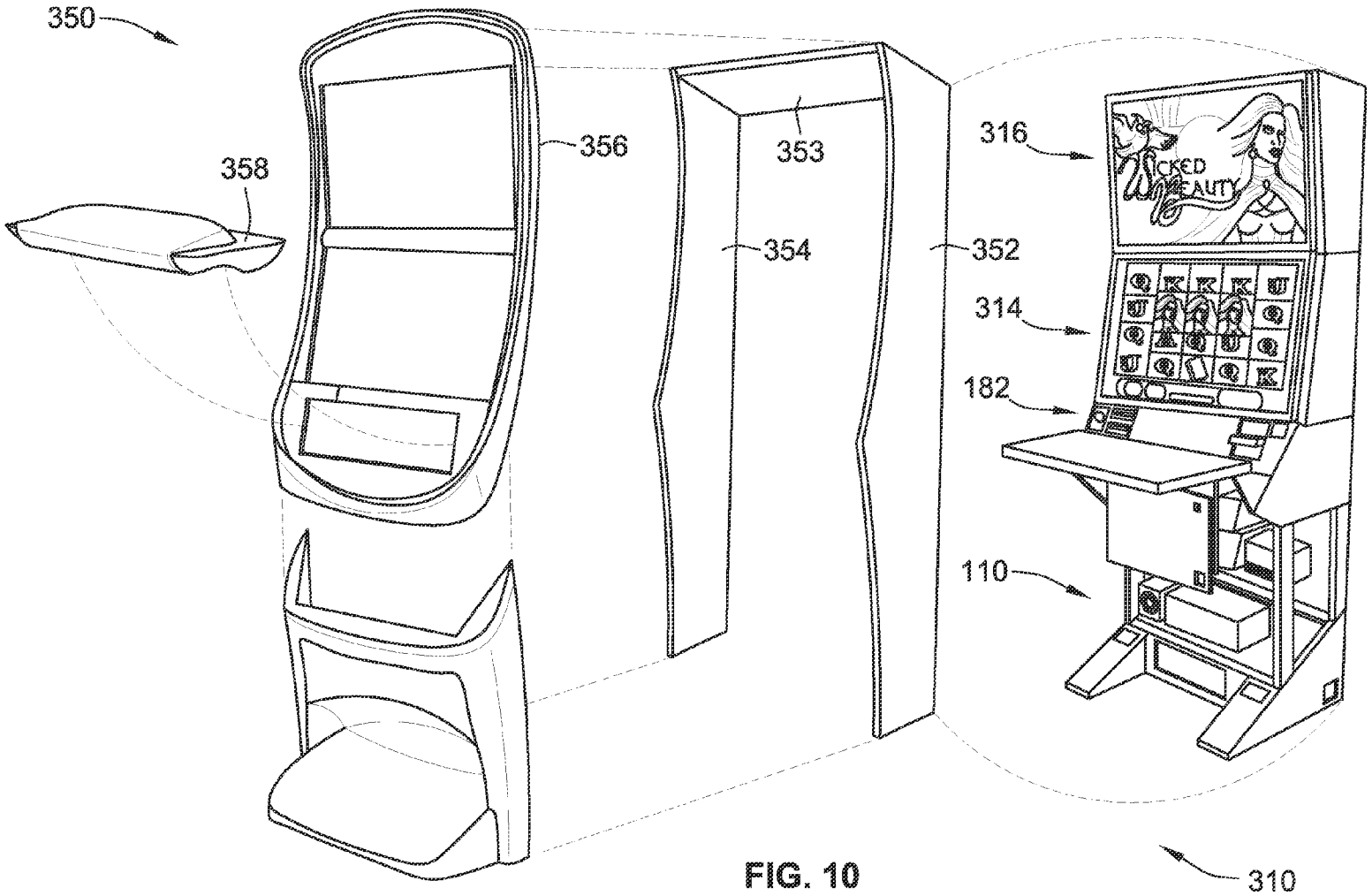
FIG. 10 is a partially exploded perspective view illustrations of the representative gaming machine configuration of FIG. 9C.

The male-and-female mounting interface sets describe above also enable ready removal and replacement of one or both of the display modules 114, 116, e.g., with substitute display and accessory modules (see, e.g., FIGS. 9A-9C). As discussed in further detail below, each substitute display/accessory module includes a housing with a corresponding display device and/or game-related accessory that is/are mounted to the housing. It is envisioned that many of these substitute display modules will each be at least partially, if not markedly structurally dissimilar from the display module it is replacing. Notwithstanding these structural distinctions, the housing of the substitute display module will include one or more of the above-described male mounting interfaces, one or more of the above-described female mounting interfaces, or combinations of both. Upon removal of the first or the second display module 114, 116, the substitute display housing can thus be readily removably mounted to the housing of the subjacent module via moving the male/female mounting interface of the substitute display housing into the corresponding female/male mounting interface of the subjacent module, as described above, to thereby automatically align the two modules and removably attach together the housings of the two modules.

FIGS. 9A-9C are perspective view illustrations of three representative modular gaming machine configurations, designated generally as 310, 410 and 510, each with a distinct footprint, height and outer appearance. These distinct sizes and facades are provided by the universal core module 140 of FIG. 4 supporting different combinations of display modules and concomitantly different combinations of outer facia paneling and trim structures. FIGS. 9A-9C can be representative of a module system utilizing a flexible and changeable cabinet configuration to provide gaming terminals of different configurations for conducting wagering games. It should be recognized that the gaming terminals 310, 410, 510 illustrated in FIGS. 9A-9C can be similar in function, operation and connectivity to the gaming terminal 110 discussed above with respect to FIGS. 4-8 and, thus, can include any of the options, features and alternatives described herein. Consequently, the "primary" and "secondary" display modules of FIGS. 9A-9C can also include any of the options, features and alternatives described above with respect to the "primary" and "secondary" display modules 114, 116 of FIG. 4 unless logically prohibited or expressly disclaimed.

As indicated above, the "universal" core module 140 of FIG. 4 is configured to receive, couple with, structurally support, and control/power an assortment of interchangeable display and accessory modules. There are shown in FIGS. 9A-9C three representative, interchangeable "primary" display modules: a first "primary" display module 314, a second "primary" display module 414, and a third "primary" display module 514. The three "primary" display modules 314, 414, 514 of FIGS. 9A-9C can be considered "substitute" display modules for at least the primary display module 114 of FIG. 4. Each of these display modules 314, 414, 514 includes a respective "primary" display device 315, 415 and 515, each of which is operable to display randomly selected outcomes of a corresponding wagering game. As some non-limiting examples: the first "primary" display device 315 comprises five vertically oriented, laterally spaced electro-mechanical symbol-bearing slot reels disposed behind a 28-inch-diagonal transmissive LCD video display panel; the second "primary" display device 415 is a 30-inch-diagonal flat-screen HiDef organic light emitting diode (OLED) video display panel; and, the third "primary" display device 515 is a 32-inch-diagonal flat-screen edge-lit HiDef LCD video display panel. Because the display devices are different sizes, the first "primary" display module 314 has a first set of dimensions (e.g., a first primary module width and height), while the second "primary" display module 414 has a second set of dimensions (e.g., a second primary module width and height) different from the first set, and the third "primary" display module 514 has a third set of dimensions (e.g., a third primary module width and height) different from the first and second sets of dimensions. For some embodiments, at least one dimension in each set (e.g., width and/or height) is distinct from the other sets.

In a similar regard, there are shown in FIGS. 9A-9C three representative, interchangeable "secondary" display modules: a first "secondary" display module 316, a second "secondary" display module 416, and a third "secondary" display module 516. The three "secondary" display modules 316, 416, 516 of FIGS. 9A-9C can be considered "substitute" display modules for at least the secondary display module 114 of FIG. 4. Each of these "secondary" display modules 316, 416, 516 includes a respective display device 317, 417 and 517, each of which is operable to display aspects of a corresponding wagering game, such as bonus games, community games, progressive games, advertisements, game-related information, non-game-related information, etc. As some non-limiting examples: the first "secondary" display device 317 is a 28-inch-diagonal flat-screen high-resolution plasma video display panel; the second "secondary" display device 417 is a 30-inch-diagonal top-box display with backlit glass artwork; and, the third "secondary" display device 517 is another 32-inch-diagonal flat-screen edge-lit HiDef LCD video display panel. Once again, because the "secondary" display devices 317, 417, 517 have different sizes, the first "secondary" display module 316 has a first set of dimensions (e.g., a first secondary module width and height), the second "primary" display module has a second set of dimensions (e.g., a second secondary module width and height) different from the first set, while the third "primary" display module has a third set of dimensions (e.g., a third secondary module width and height) different from the first and second sets of dimensions. For some embodiments, at least one dimension in each set (e.g., width and/or height) is distinct from the other sets.

In accord with the module system illustrated in FIGS. 9A-9C, each modular gaming machine configuration 310, 410, 510 is associated with a distinct set of outer fascia elements. A first set of outer fascia elements, collectively designated as 350 in FIG. 9A, is configured to attach to the first "primary" display module 314, the first "secondary" display module 316, and the core module 140. Contrastingly, a second set of outer fascia elements, collectively designated as 450 in FIG. 9B, is configured to attach to the second "primary" display module 414, the second "secondary" display module 416, and the core module 140. Lastly, a third set of outer fascia elements, collectively designated as 550 in FIG. 9C, is configured to attach to the third "primary" display module 514, the third "secondary" display module 516, and the core module 140. It may be desirable, for at least some preferred embodiments, that each set of outer fascia elements covers the majority of the forward-facing outer surfaces of the gaming terminal, and covers most or all of the side-facing and upward-facing outer surfaces of the gaming terminal. Optionally, each set of outer fascia elements covers most or all the rearward-facing outer surfaces of the gaming terminal. In some embodiments, the first set of outer fascia elements 350 can be configured to attach to the core module 140 and the first "primary" and "secondary" display modules 314, 316, but not the second "primary" and "secondary" display modules 414, 416 or the third "primary" and "secondary" display modules 514, 516. Likewise, the second set of outer fascia elements 450 can be configured to attach to the core module 140 and the second "primary" and "secondary" display modules 414, 416, but not the first "primary" and "secondary" display modules 314, 316 or the third "primary" and "secondary" display modules 514, 516.

At any given time, the housing 182 of the core module 140 may be limited to mechanically attaching to and providing subjacent support for one of the "primary" display modules, one of the "secondary" display modules, and one set of outer fascia elements. Likewise, at any given time, the electrical components stowed within the core housing 182 can be limited to electrically connecting to only the one "primary" display module and only the one "secondary" display module mounted on the core module 140. When comparing FIGS. 9A, 9B and 9C, it can be seen that: (1) mounting the first "primary" display module 314, the first "secondary" display module 316, and the first set of outer fascia elements 350 onto the housing 182 of the core module 140 generates a first distinct gaming machine configuration 310 with a first distinct footprint and a first distinct outer appearance; (2) mounting the second "primary" display module 414, the second "secondary" display module 416, and the second set of outer fascia elements 450 onto the housing 182 of the core module 140 provides a second distinct gaming machine configuration 410 with a second distinct footprint and a second distinct outer appearance is provided; and (3) by mounting the third "primary" display module 514, the third "secondary" display module 516 and the third set of outer fascia elements 550 onto the housing 182 of the core module 140, a third distinct gaming machine configuration 510 is provided with a first distinct footprint and a first distinct outer appearance.

For the first modular gaming machine configuration 310, the first "primary" and "secondary" display modules 314, 316 are smaller than their counterpart modules in the other modular gaming machine configurations 410 and 510. Likewise, the second "primary" and "secondary" display modules 414, 416 of the second modular gaming machine configuration 410 are smaller than their counterpart modules in the third modular gaming machine configuration 510. In this regard, the first modular gaming machine configuration 310 has a first set of modular gaming machine dimensions, which includes a first overall width W1, a first overall depth D1, and a first overall height H1. The second modular gaming machine configuration 410 has a second set of dimensions, which includes a second overall width W2, a second overall depth D2, and a second overall height H2. Moreover, the third modular gaming machine configuration 510 has a third set of dimensions, which includes a third overall width W3, a third overall depth D3, and a third overall height H3.

In some embodiments, the overall width W2 (and, optionally, the overall depth D2) of the second modular gaming machine 410 is larger than overall width W1 (and, optionally, the overall depth D1) of the first modular gaming machine 310, such that the second modular gaming machine 410 occupies a larger overall surface area than the overall surface area occupied by the first modular gaming machine 310. Put another way, the distinct footprint of the second distinct gaming machine configuration 410 is larger than the distinct footprint of the first distinct gaming machine configuration 310. Likewise, in some embodiments, the overall width W3 (and, optionally, the overall depth D3) of the third modular gaming machine 510 is larger than overall width W2 (and, optionally, the overall depth D2) of the second modular gaming machine 410, such that the third modular gaming machine 510 occupies a larger overall surface area than the overall surface area occupied by the second modular gaming machine 410. In other words, the distinct footprint of the third distinct gaming machine configuration 510 is larger than the distinct footprint of the first distinct gaming machine configuration 310. In addition, the third overall height H3 of the third distinct gaming machine configuration 510 is larger than the first and second overall heights of the first and second distinct gaming machine configuration 310, 410, while the second overall height H1 of the second distinct gaming machine configuration 410 is larger than the first overall height H1 of the first distinct gaming machine configuration 310.

Each set of outer fascia elements 350, 450, 550 is at least partially structurally distinct from the other sets of fascia elements such that mounting a set of outer fascia elements and the corresponding display module(s) onto the core module 140 provides a distinct gaming machine configuration with a distinct outer appearance. As can be understood from the example illustrated in FIG. 10, each set of outer fascia elements (e.g., set 350 in FIG. 10) can include one or more fascia panels 352, 353 and 354, e.g., that mount to and cover the side-facing and top-facing surfaces of the underlying cabinet structure. Each set of fascia elements may further comprise one or more trim component 356, 357 and 358, e.g., that mount to and cover some or most of the forward-facing surfaces of the underlying cabinet structure. In this regard, the second set of outer fascia elements 450 includes one or more fascia panels 452 and one or more trim components 456, 457 and 458 that are different from the fascia panels 352-355 and the trim components 356-358, respectively, of the first gaming machine configuration 310. Likewise, the third set of outer fascia elements 550 includes one or more fascia panels 552 and one or more trim components 556, 557 and 558 that are different from the fascia panels 352-355, 452-455 and trim components 356-358, 456-458, respectively, of the first and second gaming machine configurations 310, 410.

FIGS. 9A-9C also show each modular gaming machine configuration 310, 410, 510 with a respective player input module 342, 442 and 542, each of which includes a respective input device mounted to a respective housing. The player input modules 342, 442 and 542 of FIGS. 9A-9C can include any of the options, features and alternatives described above with respect to the player input module 142 of FIG. 4 unless logically prohibited or expressly disclaimed. As indicated in the preceding paragraph, each of the player input modules 342, 442 and 542 is associated with and at least partially covered by a corresponding trim component 358, 458, 558, respectively. As such, mounting a player input modules 342, 442 and 542 onto the core module 140 with the corresponding display module(s) and corresponding outer fascia elements helps to provide one or the illustrated distinct gaming machine configurations with a distinct outer appearance.

Figures 11A, 11B, 11C:
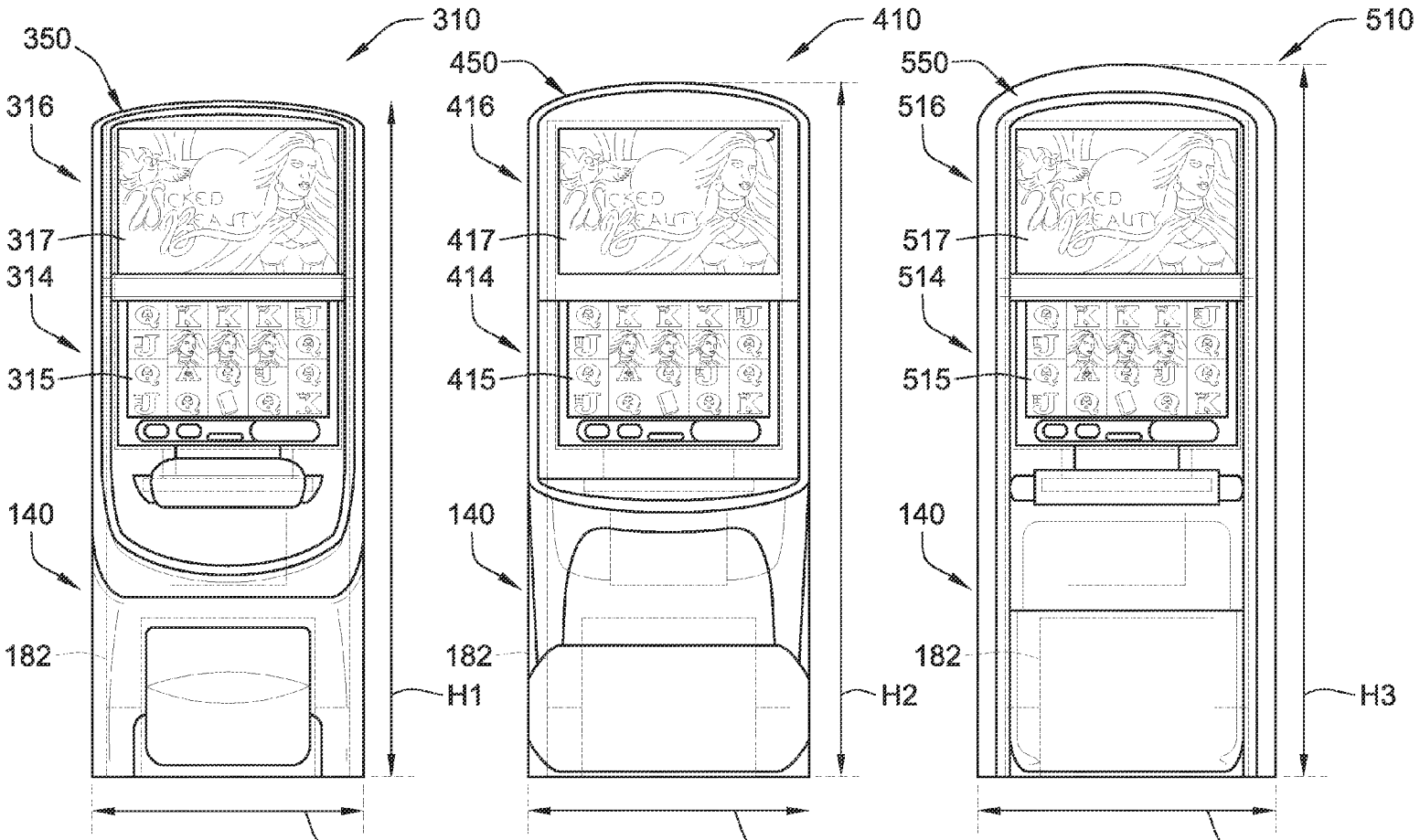
FIGS. 11A-11C are front view illustrations of the three representative gaming machine configurations illustrated in FIGS. 9A-9C, respectively.

FIGS. 11A-11C are front-view illustrations of the three modular gaming machine configurations 310, 410, 510 presented in FIGS. 9A-9C. As indicated above, the "primary" display modules 314, 414, 514 of these modular gaming machines 310, 410, 510 each has a distinct display device 315, 415, 515, respectively, and each has a distinct set of dimensions, while the "secondary" display modules 316, 416, 516 each has a distinct display device 317, 417, 517, respectively, and each has a distinct set of dimensions. In addition, each modular gaming machine 310, 410, 510 is associated with a distinct set of outer fascia elements 350, 450, 550 that provides a distinct gaming machine configuration with a distinct outer appearance. The first modular gaming machine configuration 310 has a first set of modular gaming machine dimensions, which, for some embodiments, includes a first overall width W1 of approximately 30 inches and a first overall height H1 of approximately 72 inches. The second modular gaming machine configuration 410 has a second set of dimensions, which, for some embodiments, includes a second overall width W2 of approximately 40 inches and a second overall height H2 of approximately 74 inches. Moreover, the third modular gaming machine configuration 510 has a third set of dimensions, which, for some embodiments, includes a third overall width W3 of approximately 32 inches and a third overall height H3 of approximately 80 inches. In these examples, the core housing 182 of the "universal" core module 140 has the same height and width (e.g., 30-inch wide and 35-inch tall common core). However, as indicated above, once the outer fascia elements 350, 450, 550 are added, the modular gaming machines 310, 410, 510 take on a seamless, unitary yet distinct appearance.

Also disclosed herein are improved methods for assembling gaming machines operable to conduct wagering games and methods for assembling a modular gaming terminal operable to conduct a wagering game. These methods will be described with reference to the various aspects and features shown in FIGS. 4 through 11 of the drawings; such reference is being provided purely by way of explanation and clarification. In accord with one embodiment, for example, a method for assembling a gaming machine operable to conduct a wagering game is disclosed. The method includes: providing a display module with a display device for displaying a randomly selected outcome of the wagering game, the display module including a display housing to which is coupled the display device, the display housing including one of a male mounting interface or a female mounting interface; providing a core module with an electrical bus that is configured to electrically connect to the display device, the core module including a core housing stowing therein the electrical bus and configured to support the display module, the core housing including the other one of the male mounting interface or the female mounting interface; and, moving the male mounting interface into the female mounting interface whereby the display module automatically aligns with the core module and the core housing removably attaches to the display housing.

Other embodiments are directed to a method for assembling a modular gaming terminal that is operable to conduct a wagering game. The method includes: providing a primary display module with a primary video display device that is mounted to and supported by a primary display housing, the primary video display device being operable to display a randomly selected outcome of the wagering game, the primary display housing including a primary display housing frame with a sidewall, a top wall including a first guide pin, and a base plate defining therethrough a first guide slot; providing a secondary display module with a secondary video display device or a secondary game-related accessory, or both, mounted to and supported by a secondary display housing, the secondary display housing including a secondary display housing frame with a sidewall and a base plate defining therethrough a second guide slot; providing a core module with a processing unit and an electrical bus mounted inside a core housing, the electrical bus being configured to electrically connect the primary video display device to the processing unit, the core housing including a core housing frame for supporting thereon the primary and secondary display modules, the core housing frame including a sidewall and a top plate top plate with a second guide pin; moving the second guide pin into the first guide slot whereby the primary display module automatically aligns with the core module and the core housing removably attaches to the primary display housing; and, moving the first guide pin into the second guide slot whereby the secondary display module automatically aligns with the primary display module and the primary display housing removably attaches to the secondary display housing.

Other embodiments of the present disclosure are directed to a method for assembling modular gaming machines operable to conduct wagering games. The method includes: providing a first display module which includes a first display device that is operable to display a randomly selected outcome of a first wagering game, the first display module having a first set of dimension; providing a second display module that includes a second display device that is operable to display a randomly selected outcome of a second wagering game, the second display module having a second set of dimensions that is different from the first set of dimensions of the first display module; providing a first set of outer fascia elements that is configured to attach to the first display module; providing a second set of outer fascia elements that is configured to attach to the second display module; providing a core module including a core housing with an electrical bus stowed inside the core housing, the core housing being configured to attach, one at a time, to and provide subjacent support for the display modules, and the electrical bus being configured to electrically connect, one at a time, to the display devices; and, mounting either: (a) the first display module and the first set of outer fascia elements onto the core housing to thereby provide a first distinct gaming machine configuration with a first distinct footprint, or (b) the second display module and the second set of outer fascia elements onto the core housing to thereby provide a second distinct gaming machine configuration with a second distinct footprint.

In accordance with additional embodiments of this disclosure, a method is disclosed for assembling a modular gaming terminal operable to conduct a wagering game. This method includes providing a core module including a core housing with an electrical bus and an electrical power regulation unit stowed inside the core housing. The method then includes mounting on top of the core module one of:

(A) a first display module that includes a first display device that is operable to display randomly selected outcomes of a first wagering game, the first display module having a first set of dimensions; or (B) a second display module that includes a second display device that is operable to display randomly selected outcomes of a second wagering game that is distinct from the first wagering game, the second display module having a second set of dimensions that is different from the first set of dimensions of the first display module.

The method also includes mounting to the core module one of:

(A) a first set of outer fascia elements if the first display module is mounted onto the core housing to thereby provide a first distinct gaming machine configuration with a first distinct outer appearance; or (B) a second set of outer fascia elements if the second display module is mounted onto the core housing to thereby provide a second distinct gaming machine configuration with a second distinct outer appearance.

The method then includes electrically connecting, via one or more electrical connectors, the respective display device of the mounted one of the display modules to the electrical power regulation unit and the electrical bus of the core module. The method may further comprise: providing a first player input module (e.g., a first Button Deck Module) with a first input device mounted to a first input module housing, the first input device being configured to receive wager inputs from players to play the first wagering game; providing a second player input module (e.g., a second Button Deck Module) with a second input device mounted to a second input module housing, the second input device being configured to receive wager inputs from players to play the second wagering game; and, mounting either: (a) the first player input module to the core housing if the first display module is mounted onto the core housing, or (b) the second input module to the core housing if the second display module is mounted onto the core housing.

In some embodiments, each of the aforementioned methods include at least those steps respectively enumerated above. It is also within the scope and spirit of the present invention to omit steps, include additional steps, and/or modify the order presented above. It should be further noted that each of the foregoing methods can be representative of a single sequence of related steps; however, it is expected that each of these method will be practiced in a systematic and repetitive manner.

While many embodiments and modes for carrying out the present invention have been described in detail above, those familiar with the art to which this invention relates will recognize various alternative designs and embodiments for practicing the invention within the scope of the appended claims.

What is claimed is:

1. A gaming machine for conducting a wagering game, the gaming machine comprising:

an input device configured to receive a wager to play the wagering game;

a display module including a display device operable to display a randomly selected outcome of the wagering game, the display module including a display housing to which is coupled the display device, the display housing including one of a male mounting interface and a female mounting interface, the male mounting interface including a guide pin, the female mounting interface including a frustroconical flange extending around a circular guide slot; and a core module including an electrical bus configured to electrically connect to the display device, the core module including a core housing stowing therein the electrical bus and configured to support the display module, the core housing including the other one of the male mounting interface and the female mounting interface, wherein the female mounting interface is configured to receive the male mounting interface such that moving the male mounting interface into the female mounting interface automatically aligns the display housing with the core housing and removably attaches the core housing to the display housing.

2. The gaming machine of claim 1, wherein the guide pin is a self-locating guide pin projecting from the display housing or the core housing.

3. The gaming machine of claim 1, wherein the self-locating pin includes a cylindrical stem and semispherical cap.

4. The gaming machine of claim 1, wherein the guide slot is defined in the display housing or the core housing.

5. The gaming machine of claim 1, wherein the guide pin projects upwardly from the core housing or downwardly from the display housing such that the guide pin, when automatically aligned with the guide slot, slides into the guide slot under the weight of the display module.

6. The gaming machine of claim 1, wherein the guide pin and the guide slot are both characterized by a lack of helical threads.

7. The gaming machine of claim 1, wherein the display and core housings each includes a respective bolt hole, and wherein moving the male mounting interface into the female mounting interface automatically aligns the bolt holes such that a complementary bolt can be passed therethrough.

8. The gaming machine of claim 1, wherein the display housing includes a second one of the male mounting interface and the female mounting interface, and the core housing includes a second one of the other one of the male mounting interface and the female mounting interface, the second female mounting interface being structurally configured to receive therein the second male mounting interface.

9. The gaming machine of claim 8, wherein the removably attaching the display module to the core module consists essentially of (a) moving the male mounting interfaces into the female mounting interfaces, and (b) securing the display housing to the core housing via one or more threaded fasteners.

10. The gaming machine of claim 1, further comprising:

a second display module with a second display device operable to display aspects of the wagering game, the second display module including a second display housing to which is coupled the second display device, the second display housing including a third one of a male mounting interface and a female mounting interface, wherein the display housing of the display module includes a third one of the other one of the male mounting interface and the female mounting interface, and wherein the third female mounting interface is structurally configured to receive therein the third male mounting interface such that moving the third male mounting interface into the third female mounting interface automatically aligns the second display module with the display module and removably attaches the second display housing to the display housing.

11. The gaming machine of claim 1, wherein the display housing includes a bottom wall with a sidewall projecting upwardly therefrom, and the core housing includes a top wall with a sidewall projecting downwardly therefrom, and wherein moving the male mounting interface into the female mounting interface aligns the display housing sidewall with the core housing sidewall and positions the display housing bottom wall adjacent the core housing top wall.

12. The gaming machine of claim 1, wherein the core module further comprises a processing unit stowed inside the core housing and configured to electrically connect to the display device via the electrical bus.

13. The gaming machine of claim 1, further comprising:

a substitute display module including a substitute display housing and a substitute display device mounted to the substitute display housing, the substitute display device being operable to display the randomly selected outcome of the wagering game, the substitute display module being at least partially structurally dissimilar from the primary display module, the substitute display housing including the male mounting interface or the female mounting interface included in the display module;

wherein, upon removal of the display module, the substitute display housing is configured to removably mount to the core housing via moving the male mounting interface into the female mounting interface to thereby automatically align the substitute display module with the core module and removably attach the core housing to the substitute display housing.

14. The gaming machine of claim 1, wherein the display module and the core module are physically distinct units that are selectively separable from one another without disassembling or physically damaging either module.

15. A modular gaming terminal for conducting a wagering game, the gaming terminal comprising:

an input device configured to receive a wager to play the wagering game;

a display module including a display housing and a video display device mounted to and supported by the display housing, the video display device being operable to display a randomly selected outcome of the wagering game, the display housing including a display housing frame with a sidewall and a base plate defining therethrough a circular guide slot with a frustroconical flange extending around the circular guide slot; and a core module including a core housing with a central processing unit (CPU) and an electrical bus mounted inside the core housing, the electrical bus being configured to electrically connect the video display device to the CPU, the core housing including a core housing frame with a sidewall and a top plate configured to support thereon the display module, the top plate including a self-locating guide pin projecting upwardly therefrom, wherein the guide slot is configured to receive the self-locating guide pin such that moving the guide pin into the guide slot automatically positions the display housing sidewall adjacent the core housing sidewall and positions the base plate of the display housing against the top plate of the core housing.

16. A method for assembling a gaming machine operable to conduct a wagering game, the method comprising:

providing a display module with a display device operable to display a randomly selected outcome of the wagering game, the display module including a display housing to which is coupled the display device, the display housing including one of a male mounting interface or a female mounting interface, the male interface including a guide pin, the female mounting interface including a circular guide slot with a frustroconical flange extending around the circular guide slot;

providing a core module with an electrical bus configured to electrically connect to the display device, the core module including a core housing stowing therein the electrical bus and configured to support the display module, the core housing including the other one of the male mounting interface or the female mounting interface; and moving the male mounting interface into the female mounting interface whereby the display housing automatically aligns with the core housing via the circular guide slot receiving therein the guide pin and the core housing removably attaches to the display housing.

* * * * *